United States Patent [19]

Bodnar

[11] 4,027,517

[45] June 7, 1977

[54] METHOD AND APPARATUS FOR EMBOSSING SHEET METAL STRIP AND SHEET METAL PANEL

[76] Inventor: Ernest Robert Bodnar, R.R. No. 1 Kingsworth Road, Kingscross Estates, King City, Canada

[22] Filed: May 27, 1975

[21] Appl. No.: 580,709

Related U.S. Application Data

[63] Continuation-in-part of Ser. No. 431,098, Jan. 7, 1974, abandoned.

[52] U.S. Cl. ..... 72/177; 72/185; 72/187; 72/190

[51] Int. Cl.[2] ..... B21D 21/00

[58] Field of Search ..... 72/177, 27, 185, 187, 72/190, 196; 113/1 C

[56] References Cited

UNITED STATES PATENTS

| | | | |
|---|---|---|---|
| 1,212,482 | 1/1917 | Harrison | 72/190 |
| 1,237,732 | 8/1917 | Wheeler | 72/190 |
| 2,370,702 | 3/1945 | Yoder | 72/177 |
| 3,367,161 | 2/1968 | Avakian | 72/196 |
| 3,382,695 | 5/1968 | Cape | 72/190 |
| 3,673,838 | 7/1972 | Clempson | 72/187 |

*Primary Examiner*—Lowell A. Larson

[57] ABSTRACT

This specification discloses strip sheet metal panels formed with transverse indentations and longitudinal formations formed therein, with end portions at each end of said panels being free of said transverse indentations;

and a method of cold rolling strip sheet metal to form both transverse and longitudinal indentations and formations therein, and discontinuing formation of said transverse indentations at predetermined spaced intervals along such sheet metal, and shearing the sheet metal in measured relation to such spaced intervals;

and further dicloses apparatus for embossing sheet metal, in a sheet metal forming line adapted to form both transverse and longitudinal indentations in said sheet metal, and in which said forming line includes sheet metal delivery means, and a plurality of sheet metal roller stands for forming said longitudinal indentations and in which said embossing apparatus incorporates tension roll means located and adapted to receive said sheet metal from said sheet metal delivery means, embossing roll means located to receive said strip from said tension roll means and moving die means cooperating with said embossing roll means thereby to draw said sheet metal into formations on said embossing roll means and thereby form said transverse indentations in an intermediate central region thereof, and, holding roll means adapted to engage said embossed indentations and hold said sheet metal in said formations, said sheet metal thereafter passing through said roller stands for formation of said longitudinal indentations in marginal areas of said strip unaffected by said embossing roll means and means for intermittently disengaging said moving die means from said embossing roll means to permit portions of said sheet metal to pass therearound without formation of said indentations.

23 Claims, 29 Drawing Figures

METHOD AND APPARATUS FOR EMBOSSING SHEET METAL STRIP AND SHEET METAL PANEL

The present invention relates to embossing apparatus which may be located in a sheet metal strip roll forming line, and forms transverse indentations across the sheet metal strip, or across a part of the strip, and is a Continuation-in-Part of application Ser. No. 431,098, METHOD AND APPARATUS FOR EMBOSSING SHEET METAL STRIP, filed Jan. 7, 1974, now abandoned.

The invention further relates to embossed sheet metal strip, as an end product, and further relates to a method of operating a strip roll forming line and embossing apparatus to form such embossed sheet metal strip.

BACKGROUND OF THE INVENTION

In the art of roll forming sheet metal, it has for many years been considered desirable to emboss transverse indentations across a strip passing along a sheet metal rolling line, or across a part of the strip, so as to provide increased strength, or to provide for a specific function in an end product. The provision of transverse indentations, coupled with the formation of longitudinal indentations or formations, in a sheet metal strip, greatly increases the rigidity of the strip, and such increase in rigidity leads to various economies, principally due to the fact that a lighter gauge of metal may be used for specific applications than was hitherto possible. For example, in the manufacture of roof decking, sheet metal having a combination of transverse indentations and longitudinal indentations is found to have much greater rigidity and thereby permits the use of lighter gauge steel, thereby making the roof decking somewhat cheaper. In addition, the use of lighter weight material permits the use of somewhat lighter gauge beams in the roof, and other supports in the building structure which thereby permits considerable savings in construction costs over conventional materials.

However, notwithstanding the desirability of such products, progress in the development of manufacturing techniques for such products in the past has been disappointing. Various proposals have been put forward for manufacturing these types of products.

For example, U.S. Pat. No. 3,137,922 shows a method of manufacturing such a product incorporating transverse indentations in the form of an elongated diamond. In this process, the sheet metal strip was first of all passed through a series of roll forming dies or so called "stands" to form longitudinal channel like formations along either edge of the strip, after which the strip was passed through a group of cold working rolls, to flex and extend a portion of the central web of the strip, and then the strip was passed through one pair of embossing rolls. In practice, however, this process was found to produce uneven indentations, with irregular folds or ridges in the metal which did not conform accurately to the shape of the embossing rolls. As a result, the line was difficult to run, and the end product was possessed of uneven and unpredictable stress properties such that it could not in practice be relied upon with any accuracy.

U.S. Letters Pat. No. 3,394,573, granted to E. R. Bodnar, shows a process of embossing transverse indentations without any previous cold working step. Again, while this line was found to be satisfactory for producing relatively simple sections, where both the transverse and the longitudinal indentations were more or less the same depth, it was not found to be entirely satisfactory for producing more complex formations. In addition, while the foregoing proposals describe systems capable of producing a metal strip with continuous deformations formed therein, they were not capable of producing intermittent lengths of such material with indentations formed in some parts, and not others, and accordingly the usefulness of and not in others, and accordingly the usefulness of the earlier systems was somewhat restricted.

BRIEF SUMMARY OF THE INVENTION

The invention therefore seeks to provide apparatus for embossing sheet metal, in a sheet metal forming line adapted to form both transverse and longitudinal indentations in said sheet metal, and in which said forming line includes sheet metal delivery means, and a plurality of sheet metal roller stands for forming said longitudinal indentations, and in which said embossing apparatus incorporates tension roll means located and adapted to receive said sheet metal from said sheet metal delivery means, embossing roll means located to receive said strip from said tension roll means and moving die means cooperating with said embossing roll means whereby to draw said sheet metal into formations on said embossing roll means and thereby form said transverse indentations in an intermediate central region thereof and holding roll means adapted to engage said indentations, and hold said sheet metal in said formations, said sheet metal thereafter passing through said roller stands for formation of said longitudinal indentations in marginal areas of said strip unaffected by said cold working roll means and said embossing roll means and means for intermittently disengaging said moving die means from said embossing roll means to permit portions of said sheet metal to pass therearound without formation of said indentations.

More particularly, it is the objective of the present invention to provide an apparatus of the type described and having the foregoing advantages in which the moving die means comprise a plurality of individual separate die members, arranged on a continuous moving conveyor system, and moving around a predetermined arc of said embossing roll means.

Preferably the moving die members are individually movable on the conveyor between engaging and disengaging positions, and means are provided for selectively moving same to disengage from said sheet metal as aforesaid.

More particularly, it is an objective of the invention to provide an apparatus of the type described, and having the foregoing advantages and in which the strip sheet metal working line incorporates flying shear means adapted and operable to cut off said sheet metal at intervals, electronic measuring means procuring measured operation thereof, electronic measuring means operating said moving die means to release and engage said sheet metal in measured relationship to the operation of said flying shear whereby to procure lengths of said sheet metal in predetermined measurements, with portions thereof embossed and portions thereof free of embossing.

It is a further and related objective of the invention to provide apparatus of the type described in which holding pressure is maintained on said sheet metal as it passes around an arc of said embossing roll means, preferably in excess of 180° thereof.

It is a further and related objective of the invention to provide a method of cold rolling strip sheet metal to form both transverse and longitudinal indentations and formations therein, and discontinuing formation of said transverse indentations at predetermined spaced intervals along such sheet metal, and shearing the sheet metal in measured relation to such spaced intervals.

It is a further and related objective of the invention to provide strip sheet metal panels formed with transverse indentations and longitudinal formations formed therein, with end portions at each end of said panels being free of said transverse indentations.

A preferred embodiment of the invention will now be described by way of example only.

DETAILED DESCRIPTION OF A SPECIFIC EMBODIMENT

Figure 1:
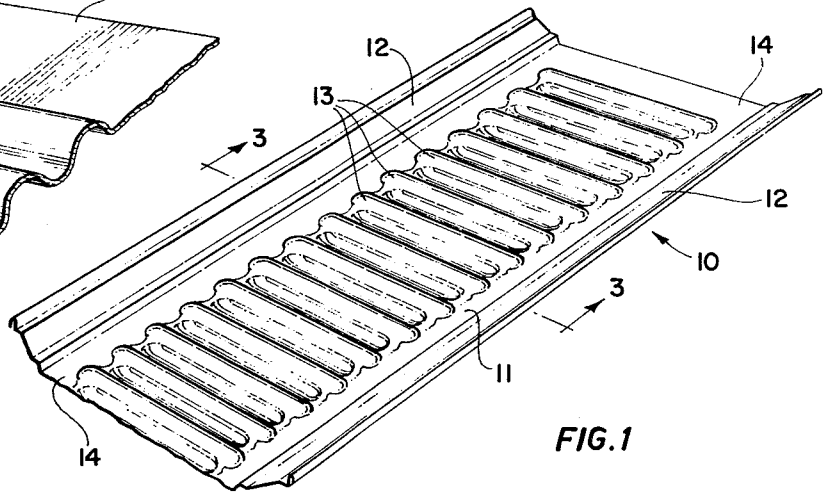
FIG. 1 is a perspective illustration of a panel of embossed sheet metal according to the invention.
Figure 2:
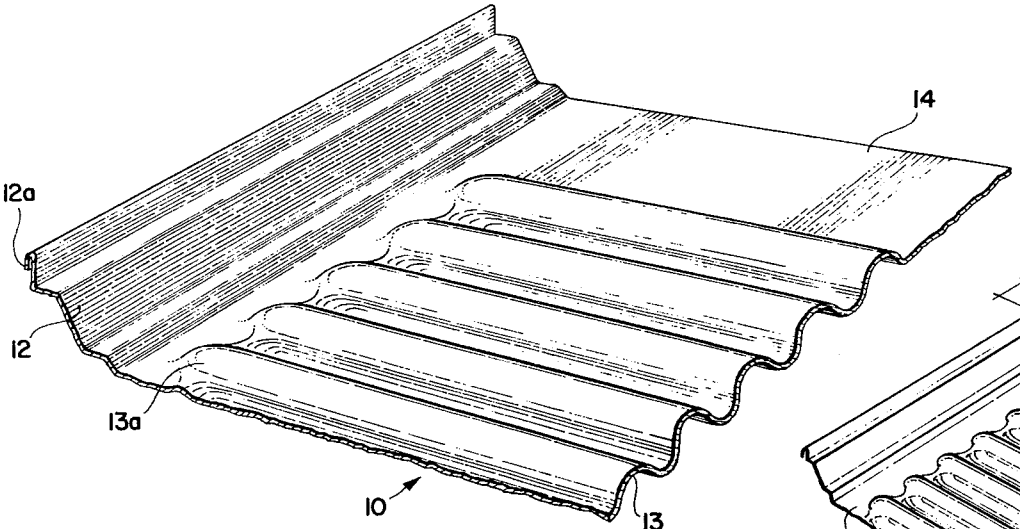
FIG. 2 is an enlarged partially cut away perspective illustration of a panel of sheet metal as shown in FIG. 1 showing the transverse indentations.
Figure 3:
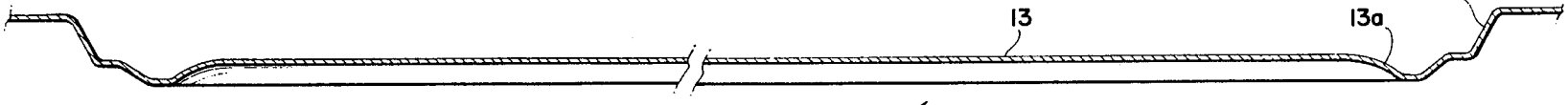
FIG. 3 is a sectional elevational view of the length of sheet metal shown in FIG. 2, along the line 3—3.

Referring now to FIGS. 1, 2 and 3 it will be seen that an embossed sheet metal panel according to the invention is shown generally as 10, and comprises an intermediate portion 11, and two side or marginal portions 12. The side or marginal portions 12 are shown with continuous lengthwise roll formed grooves or indentations, described in more detail in FIG. 2, and the intermediate portion 11 is formed with transverse indentations shown as 13. At each end of the intermediate portion 11 a flat junction portion 14 is provided, which is free of the transverse indentations 13.

As shown in more detail in FIG. 2, the transverse indentations 13 will be seen to be of a generally sine wave characteristic, and having rounded end portions 13*a*. The side or marginal portions 12 are formed with any suitable form of longitudinal indentational fold and may and preferably will incorporate some form of interlocking fold or tongue 12*a*, by means of which the panel 10 may be arranged side by side in interlocking forming to provide a continuous roof deck on a building for example. However, the invention is not to be taken as limited to rool decking panels as such, but is of course, of general application.

Figure 4:
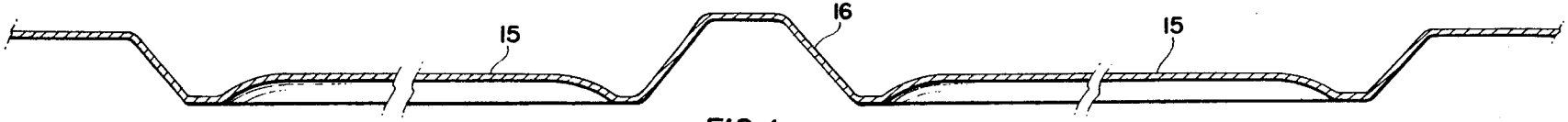
FIG. 4 is a sectional view corresponding to the section of FIG. 3 showing an alternate embodiment.

An alternate embodiment is shown in FIG. 4, and in this case it will be seen that the panel may be provided with two separate transverse indentations 15. In this case, however, the two transverse indentations 15, are discontinuous and are separated in the centre of the panel by a continuous longitudinal ridge 16.

Panels of this type are found to have greatly increased strength and stress resistant characteristics, enabling if necessary the use of a lighter gauge material, or alternatively providing much greater strength with an equivalent grade of material as compared with the panels previously in use.

Panels according to the invention are preferably manufactured by a continuous strip sheet metal forming line incorporating transverse embossing means and lengthwise roll forming means, and shear means, each of which performs their respective operation on the continuous sheet metal strip as the same passes along the line, the end product being the series of panels severed from the continuous trip by the shear.

Figure 5:
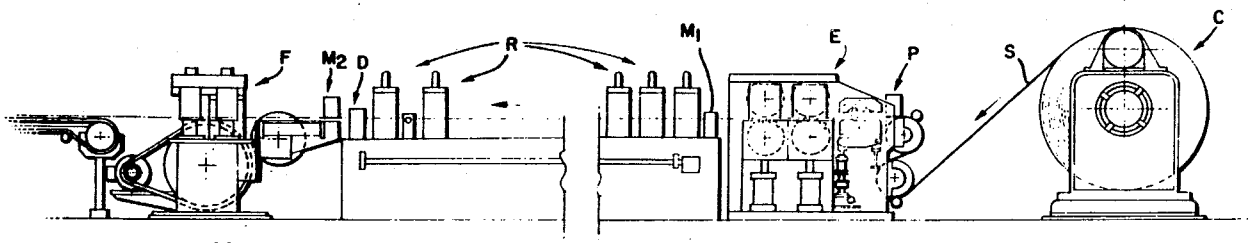
FIG. 5 is a schematic side elevational view of a strip sheet metal working line, incorporating embossing means according to the invention.

One form of such line is shown schematically in FIG. 5. It will be seen to comprise a strip sheet metal supply in the form the coil C, the metal being shown as the strip S. The transverse embossing means is shown as E, and the lengthwise roll forming dies are shown as the roll forming stands R, and the flying shear or cut-off die means is shown as F. In addition, in order to ensure accuracy in the length of the cut-off panels, a punch P is provided at the input side of the embossing means E, and a first measuring device M1 is located after the output of the embossing means E. A punch detector means D is located ahead of the flying shear F, and a second measuring device M2 is also associated with the flying shear F, the operation of which will be described later.

For the purposes of the following description, no further details will be given of the strip sheet metal supply designated by the reference C, and no further description will be given of the roller die stands R, or the flying shear F, all of which are believed to be well known in the art and require no further description. In addition, the measuring devices M1 and M2, may of course, be conventional measuring wheel devices providing an electrical signal responsive to movement of the strip S, as is well known in the art. The punch P and detector D are again conventional, the punch P merely operating to punch a small hole in the material, and the detector D being, for example, an optical device such as a photo electrical cell or the like for detecting the hole punched by the punch P. Since such units are readily available on the market, no further description will be directed to them.

Turning now to the embossing means E, one form is shown in greater detail in FIGS. 6, 7, 8 and 9. It will be seen that the embossing means E comprises a tensioning means for retarding the strip sheet metal S as it comes from the feed stand C. This tensioning means comprises the pair of bridle rolls 20 and 21, mounted one above the other on the base frame 22 to provide a generally S-shaped path around which the sheet metal S must pass. Any suitable retarding or braking means, see FIG. 10, may be provided in asociation with the bridle rolls 20 and 21, of any suitable design known in the art, which is not described herein for the sake of clarity. The function of the bridle rolls 20 and 21 is to grip the sheet metal S with sufficient friction that the same cannot slip therearound, at the same time retards the forward movement thereof so that such sheet metal S may be tensioned during the embossing thereof as described below. Snubber rolls 23 are associated therewith to further increase their effectiveness.

In some cases there may also be provided a group of cold working rolls shown generally as 24, cold working rolls being generally known in the art per se and requiring no detailed description. They may of course vary in number and in this embodiment will be seen to comprise three upper support rolls 25 mounted on a fixed upper mounting 26 which is fixed with relation to the base frame. A pair of lower support rolls 27 are mounted on a lower moveable frame 28. A pair of upper working rolls 29 are mounted between support rolls 25 on mounting 26, and a central lower working roll 30 is mounted between rolls 27 on the moveable frame 28. The support rolls 29 and 30 which would otherwise be of too small a diameter to withstand the strains imposed under working conditions.

The lower working roll 30 is of a particular shape and design, as will be described below to cold work and stretch a central portion of the sheet metal strip S while leaving the marginal portions on either side of the strip unaffected.

Figure 6:
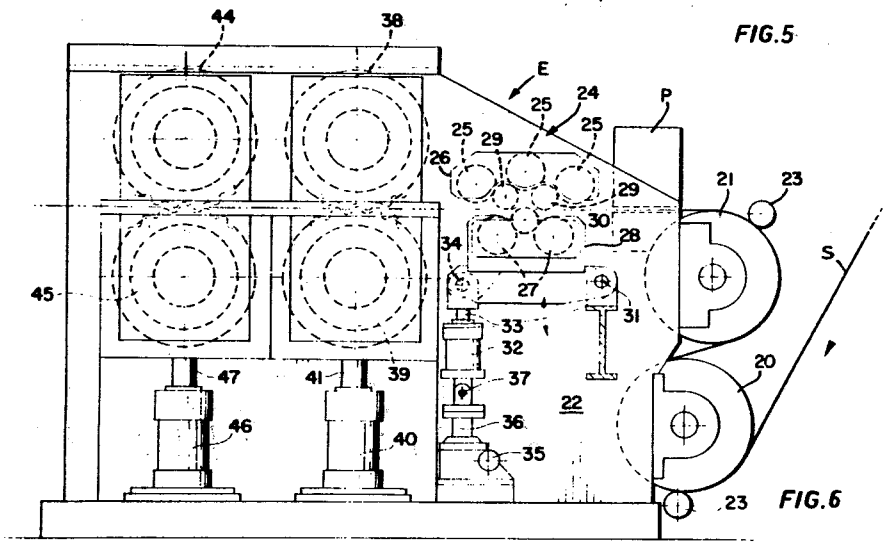
FIG. 6 is an enlarged side elevational view of the embossing means according to the invention.
Figure 8:
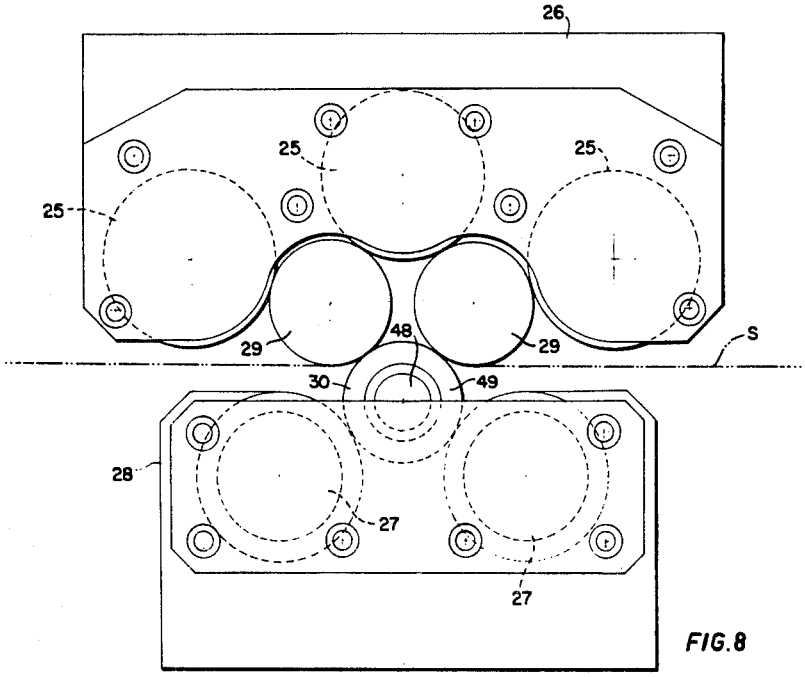
FIG. 8 is a side elevational view of the cold working roll.

The lower frame 28 which is moveable, is swingably mounted on the pivot 31 so that it may be swung downwardly and upwardly as shown in phantom, to bring the working roll 30 out of and into engagement with the sheet metal S. Clearly, when the frame 28 is swung downwardly, with the working roll 30 out of engagement with the sheet metal S, the central portion of the sheet metal S will not be deflected upwardly as shown in FIG. 6, and will therefore remain unaffected. Movement of the moveable frame 28 is controlled by means of the hydraulic cylinder 32 and piston rod 33 which is pivotally mounted as at 34 to the opposite side of the frame 28 as shown. By any suitable control means such as is shown schematically in FIG. 10, the hydraulic cylinder 32 may be operated so as to swing the frame 28 either downwardly or upwardly.

In order to control the height of the frame 28 in either position, a screw jack mechanism 35 is provided, having a connecting rod 36 extending therefrom, the free end of which is pivotally connected as at 37 to the lower end of the cylinder 32. By operation of the screw jack 35, the height position of the frame 28 may be adjusted up or down independently of the cylinder 32.

In order to emboss a transverse indentation into the strip S, a pair of embossing rolls 38 and 39 are provided, 38 being the upper roll and 39 the lower roll. The upper embossing roll 38 is fixed in relation to the base frame 22, and the lower embossing roll 39 is vertically moveable relative thereto, being moved upwardly and downwardly by means of the hydraulic cylinder 40, and connecting rod 41. Cylinder 40 is controlled as shown schematically in FIG. 10, for movement in timed sequence with the flying shear F as described below.

Figure 7:
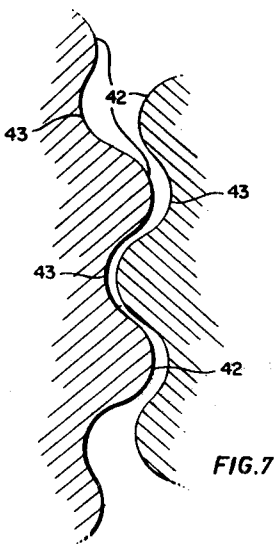
FIG. 7 is a greatly enlarged view of a portion of the embossing roll means.

With reference to FIG. 7, it will be seen that the surface of the rolls 38 and 39 is provided with matching intermeshing sinusoidal ridges and depressions shown as 42 and 43, whereby to form transverse and indentations having a generally sinusoidal cross section, conforming to the shape of the ridges and rooves 42 and 43. Ridges and depressions 42 and 43 of rollers 38 and 39 are of a width more or less corresponding to the width of the lower working roll 30, and thereby define a space or marginal area along either side of the strip S which is free of embossing.

In order to hold the strip S in tension while it is being subjected to the cold working and embossing treatments aforesaid, a pair of upper and lower holding rolls 44 and 45 are provided, substantially identical to the embossing rolls 38 and 39, and similarly having the lower roll 45 mounted on a hydraulic cylinder 46, and connected thereto by a rod 47. The rolls 44 and 45 have similar transverse ridges and grooves 42 and 43 as in the case of the embossing rolls 38 and 39, and are driven by a drive train (not shown) of any suitable design such that they interfit precisely in the transverse indentations formed in the sheet metal S by the embossing rolls 38 and 39. Preferably, according to the invention the speed of rotation of the rolls 44 and 45 is precisely matched to the speed of rotation of the embossing rolls 38 and 39, and the effect thereby applied by the rollers 44 and 45 to sheet metal S, will be resisted by the tensioning rolls 20 and 21 and the portion of the strip S passing through the cold working rolls 24 and the embossing rolls 38 and 39 will thereby be maintained in tension during treatment.

The roll stands R may be of any suitable number and design so as to form longitudinal indentations along either side of the sheet metal strip S, and require no description.

Figure 9:
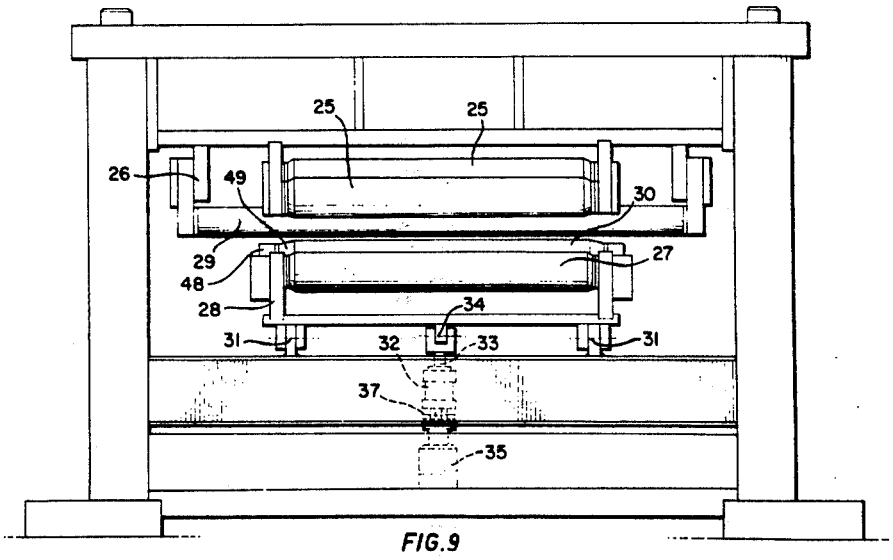
FIG. 9 is a rear elevational view of the cold working roller means, shown partially cut away, and partially in section, and, FIG. 10, is a circuit diagram of the electrical control mechanism for the embossing roll means and the strip sheet metal working line.

With reference to FIG. 9, as stated above this view is an end elevational view partially in section of the cold working rolls indicated generally as 24. The view shows one of the upper support rolls 25 and one of the lower support rolls 27, the lower moveable frame 28, and the work rolls 29 and 30. It will be noted that the lower moveable frame 28 is located within the main frame 22, the lower support rolls 27 being journalled as at 48 so that they may rotate within frame 28 freely. The lower work roll 30 is similarly journalled in the lower moveable frame 28. The lower working roll 30 will be seen to be of cylindrical shape along most of its length, but having tapered ends 49 at each end thereof, which extend to journals, (not shown). The main body of the work rolls 29 and 30 of course are contacted and supported by their respective support rolls 25 and 27 which simply are provided so as to back up the main portion of the work rolls 29 and 30 and support them during use. On either side of the lower work roll 30 the sheet metal S will, of course, pass freely without contacting roll 30 and without being cold worked or otherwise affected.

When the lower moveable frame 28 is swung downwardly as is described above, the lower rolls 27 and the lower work roll 30 are swung downwardly out of the path of the sheet metal S, and during this period the sheet metal S passes through the cold working rolls 24 without being affected at all either in its marginal regions or in its central region.

Figure 20:
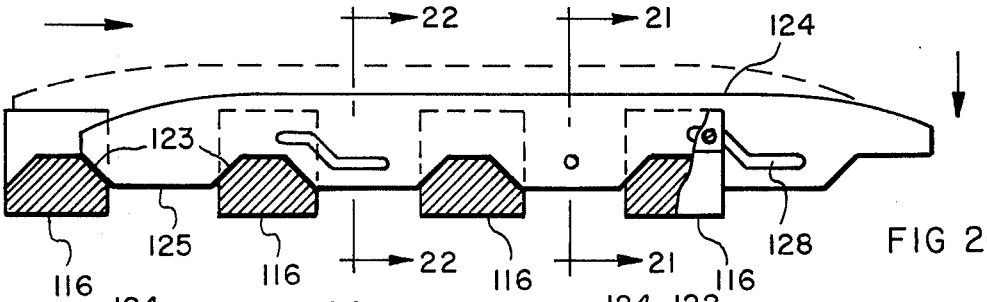
FIG. 20 is a view corresponding to FIG. 19, showing the moving die means in a disengaged position.
Figure 21:
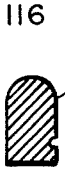
FIG. 21 is a section along the line 21—21 of FIG. 20.
Figure 22:
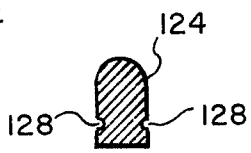
FIG. 22 is a section along the line 22—22 of FIG. 20.
Figure 23:
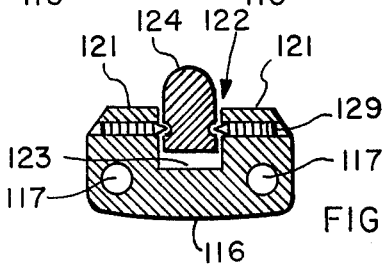
FIG. 23 is a section along the line 23—23 of FIG. 19.

Referring now to FIG. 20, it will be seen that provision is made for fully automatic operation of the apparatus described so that it may operate continuously, and will produce as an end product sheet metal products 10 having the formations as shown, of precisely regulated length, from a feed stock which consists simply of a coil of strip sheet metal S as shown. In order to provide for such automatic operation two separate electronic counting mechanisms are provided, namely the embossing unit counter 50, and the press or shear counter 51. The embossing unit counter 50 receives an input signal from the measuring wheel or measuring system M1, which is in contact with the strip sheet metal S at the output end of the embossing unit at E, and thus is measuring the actual length of sheet metal after treatment in the embossing unit E. This input signal is fed into the counter 50, and after a predetermined number of impulses, the counter 50 will trigger various different output signals. Thus the counter 50 controls the punch P, through the solenoid 52. Similarly, at the appropriate count, the counter 50, through the solenoids 53, 54 and 55, will cause the cold working roll 30, and the lower embossing and pull rolls 39 and 45 to move downwardly, thereby releasing the strip sheet metal S from engagement, and permitting it to pass therethrough without any treatment. Again, the counter 50 will deliver a subsequent signal to the solenoids 53, 54 and 55 causing them to move upwardly once more to reengage the strip S, after a suitable length of strip S has passed therethrough without treatment.

In order to procure the necessary matching of the rotational speed of the embossing rolls 38, 39 and rolls 44 and 45, the drive motor 56 is monitored by a tachometer 57, the output of which is fed into the embossing speed control 58, which is in turn connected to the motor 56 to control its speed. Similarly, in order to control the rotational speed of the roller dies (not shown) in the roll stands R, the drive motor 59 is monitored by a tachometer 60, which is similarly connected to a roll former speed control 61. Speed controls 58 and 61 are themselves connected to one another to permit controlling of their relative speeds.

In order to control the movement of the flying shear F, and to control the length to which the strip S is cut, the press or shear counter 51 receives an input signal from the punch detector D, and also receives an input signal from the measuring wheel M2. The press counter 51 provides output signals which control the flying shear F, and the speed of the motor 62 of the die accelerator 63, which forms part of the flying shear F. The motor 62 is monitored by a tachometer 64 the output of which is also fed into the counter 51 and speed control 61 whereby to precisely match the speeds of the strip S and the flying shear F.

A further tachometer 65 is provided to monitor the speed of rotation of the measuring wheel M2 to ensure precise measurement of the length of sheet metal.

Figure 10:
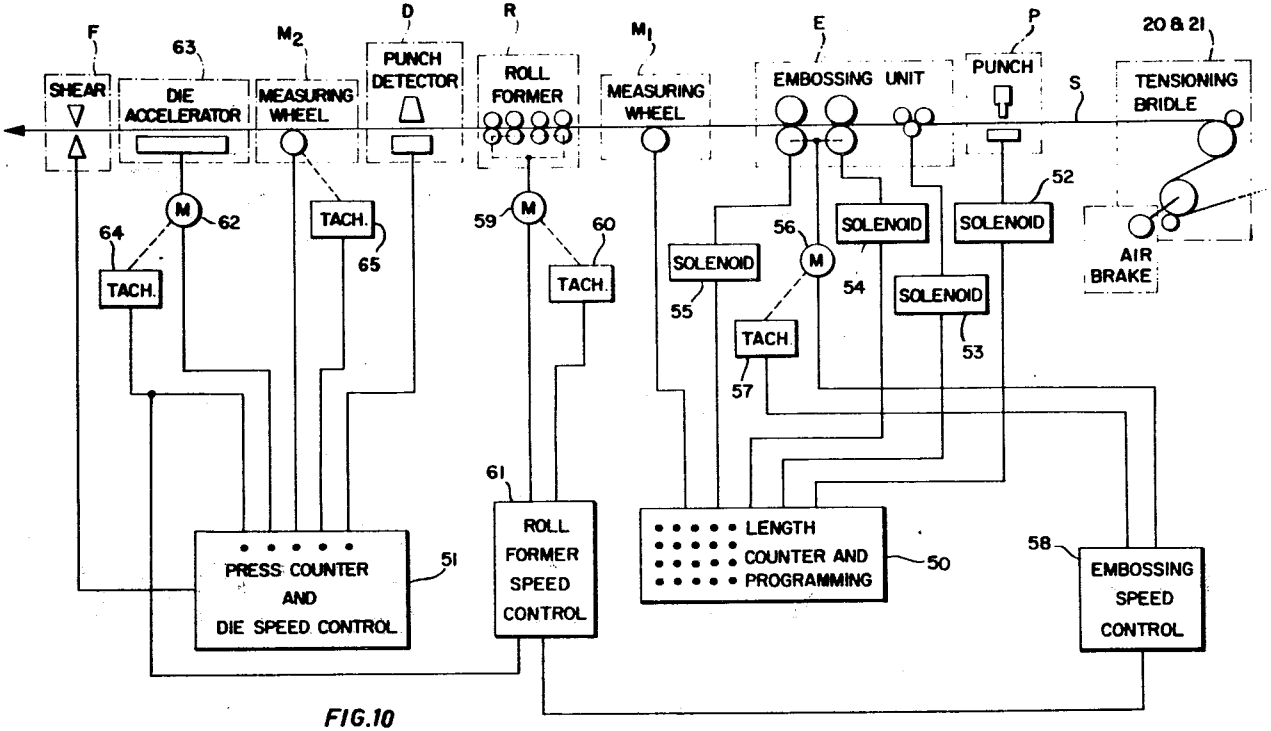

In operation, the strip sheet metal shown as S passes along the path indicated in FIG. 5 and also in FIG. 10. During its passage along this path, it is frictionally engaged and retarded along its direction of travel by means of the tensioning rollers 20 and 21, and rolls 44 and 45. The effect of this is to apply tension to the sheet metal between the tensioning rolls and the rolls 44, 45. If cold working rolls 42 are used, they cold work the central portion of the strip, as it passes over the roll 30. The portions of the strip on either side of the central portion are not cold worked at this stage. As a result, the central portion is stretched and extended, and this may improve and facilitate the subsequent embossing step. The strip then passes under tension between embossing rolls 38 and 39. Ridges 42 and depressions 43 which are essentially of the same width as the cold working roll 30 emboss transverse indentations into the central portion of the sheet metal strip, substantially as shown in FIGS. 1 and 2. Again, it will be appreciated that the strip S, being maintained substantially free of distortion or undesired flexing which might otherwise occur during the embossing step. The passage of the strip S through the pull rolls 44 and 45, as described above, applies the tension desired, by means of the matching of the indentations and ridges on rolls 44 and 45 with the indentations already formed in the strip sheet metal S by the embossing rolls 38 and 39.

Also during this stage, the punch P as shown in FIG. 10, punches an index mark in the strip S at predetermined intervals to index the length required in the finished panel. After passage of the strip S from the pull rolls 44 and 45, it passes over a measuring wheel M1, described above, and through the roll forming stands R. The roll forming stands are arranged so that the roller dies engage the strip S along either side thereof where the strip S is free from any embossing. They will then form longitudinal formations along either side of the strip S, as for example is shown in FIGS. 1 and 2, in known manner. The strip S then passes over another measuring wheel M2, and also through a punch detector D. The information obtained from the punch detector D and the measuring wheel M2 is then employed to operate the die accelerator 63 and the shear F so as to cut off the strip metal S into panels of precisely measured lengths.

The operation of the measuring wheel M1, and the embossing unit counter 50 procures operation of the solenoid 52 to operate the punch P at predetermined measured intervals, and also operates the solenoids 53, 54 and 55 so as to disengage the cold working rolls 24, and the embossing roll 39 and the roll 45 at predetermined measured intervals, whereby to provide the flat junction portions 14 at either end of the panels 10, which are free from cold working and embossing as shown.

The invention thus described will be seen to provide, a roll formed sheet metal panel formed of strip sheet metal cut to a predetermined length, said panel comprising, continuous roll formed longitudinal formations along either side of said panel running from one end to the other, a plurality of identical transverse indentations formed in the central portion of said panel, extending from side to side thereof between said longitudinal formations, and, flat planar portions of said panel at each end thereof extending from side to side of said central portion between said longitudinal formations.

The invention will further be seen to provide a method of cold rolling strip sheet metal to form sheet metal panels of predetermined lengths and comprising, tensioning a length of said strip between two spaced points, sequentially forming transverse indentations one after another in said sheet metal while the same is under tension in a central region, while leaving said remainder of said sheet metal or either side thereof unaffected, subsequently roll forming longitudinal formations in said side portions of said sheet metal which remain free of said transverse indentations, intermittently discontinuing said formation of said transverse indentations at predetermined spaced intervals along the length of said strip sheet metal, applying an index mark to said strip sheet metal at each said point of discontinuance of said transverse indentations, passing said strip sheet metal through a flying shear after completion of said longitudinal formations, sensing said indexing mark and triggering said flying shear in response thereto to sever said sheet metal at a predetermined length in the region of said discontinuance of said transverse indentations.

The invention will further be seen to provide apparatus for the formation of roll formed sheet metal panels having transverse indentations formed therein and longitudinal formations formed along either side thereof, and flat junction portions at either end which are free of said transverse indentations, said apparatus comprising embossing roll means oriented to emboss transverse indentations into a central portion of said strip, while leaving the remainder free of embossing, means for displacing part of said embossing roll means away from said sheet metal to discontinue said embossing, holding roll means adapted to engage said strip sheet metal on the downstream side of said embossing roll means, whereby to apply tension thereto, and means for displacing said roll means away from said strip sheet metal, tension roll means on the side of said embossing roll means remote from said holding roll means, operable to engage and restrain said strip sheet metal, whereby the same is tensioned between said holding roll means and said tension roll means. The invention further provides indexing means marking said strip sheet metal at predetermined measured intervals, measuring means measuring the strip sheet metal as the same passes from said holding roll means, and delivering a signal responsive to the length thereof, counter means receiving said signal, and connected to operate said indexing means, and said displaceable cold working roll means, and said displaceable embossing roll and holding roll, whereby to procure operation thereof at predetermined measured intervals in response to said signal from said measuring means, roller die means arranged to engage said strip on either side thereof adjacent said central embossed portion, and forming longitudinal formations along said side portions while leaving said central embossed portion free of such longitudinal formations, index detector means detecting said indexing mark, second measuring means measuring said strip after formation of said longitudinal formations, flying shear means operable to cut off said strip into panels of predetermined measured lengths, and counter means receiving signals from said punch detector means and said second measuring means, and connected to operate said flying shear whereby to procure operation thereof at precisely measured intervals.

Figure 11:
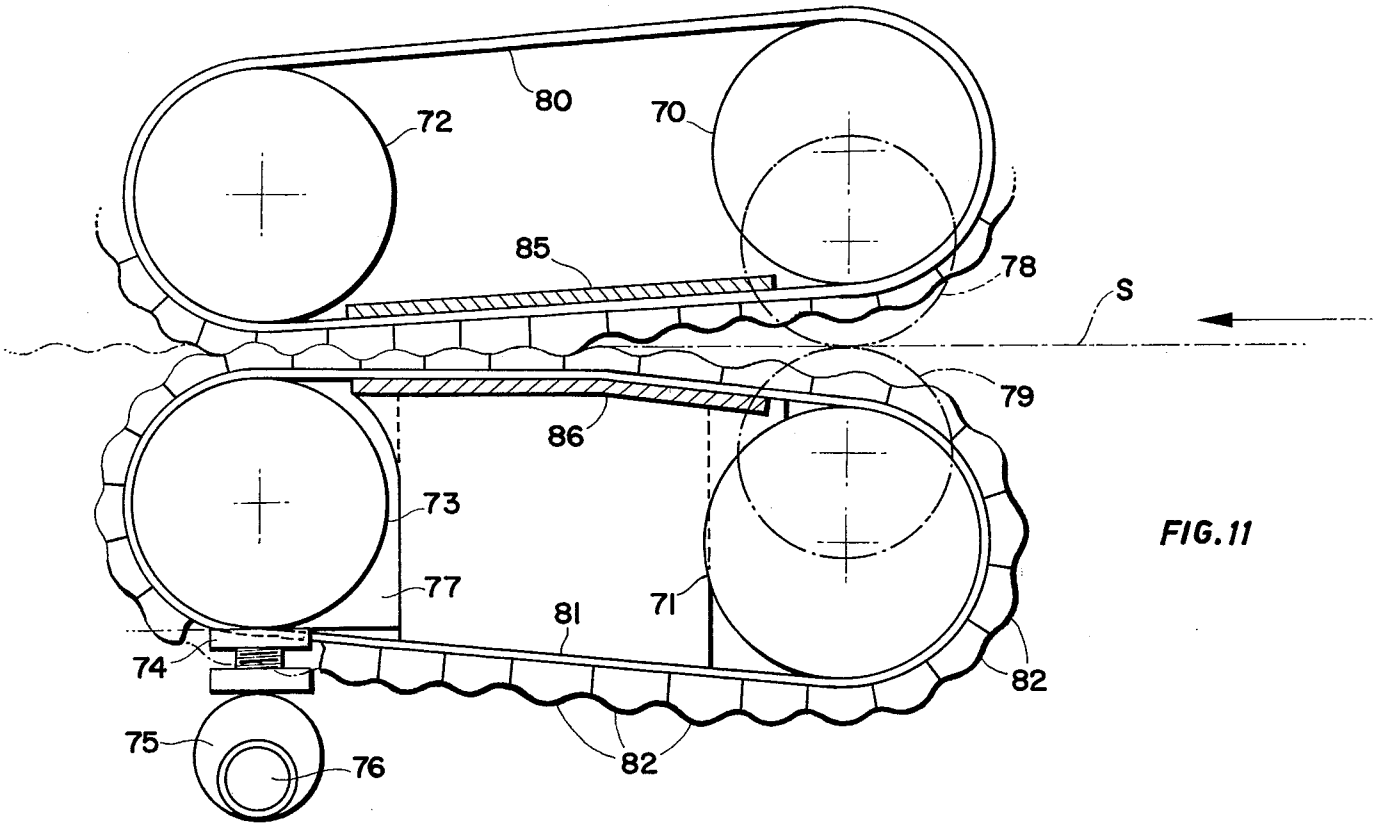
FIG. 11 is a side elevation of an alternate form of embossing means.
Figure 12:
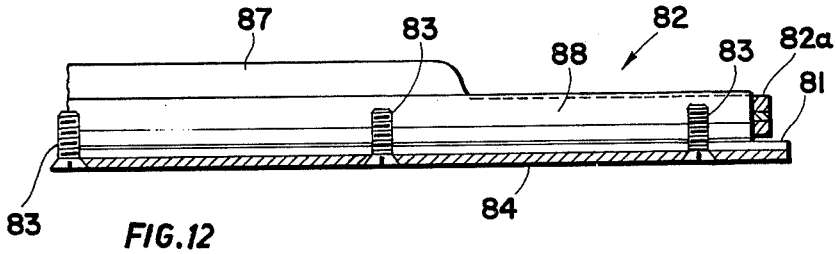
FIG. 12, is an end elevation in section along the line 12–12 of FIG. 11.

Various modifications may be made to the embossing means E. As best shown in FIGS. 11 and 12, the embossing means may by a plurality of separate die segemnts fastened around continuous belts or by links. In this way, the various ridges or depressions are formed in the strip more gradually or progressively, and with multiple die segments in contact, without the need for two separate embossing roll stands which run in synchronism during operation.

One form of such a belt mounted system is shown in FIG. 11. It will be seen to comprise a first pair of upper and lower belt support rolls 70 and 71, mounted in predetermined spaced apart relation on opposite sides of the steel strip S. A second pair of upper and lower belt support rolls 72 and 73 are provided, located on opposite sides of the steel strip S at a distance from the first pair of rolls 70 and 71, and located somewhat closer together. In this embodiment the first pair of rolls 70 and 71 are mounted in fixed spaced apart relation, although this is not critical, and they could be made adjustable if desired. The second pair of rolls 72 and 73 are made adjustable, by any suitable means in this case by means of the adjustable block 74, and the cam adjuster 75 mounted on the shaft 76.

The cam adjuster 76 can of course be rotated by means of rotation of the shaft 76 in any suitable manner, the details of which have been omitted for the sake of clarity. The adjustable block 74 is provided with threaded screw adjustment means the details of which are not shown but will be obvious to persons skilled in the art.

Clearly other forms of adjustment means could be provided. In the case of the present adjustment means however it will be seen that the adjustable block 74 engages the sliding mounting block 77 in which the two ends of the lower support roll 73 are journaled. In this way, the alignment of the moveable roll 73 may be varied at either end so as to ensure that it is parallel with the axis of the upper roll 72, and the cam 75 may be rotated to move the lower roll 73 upwardly and downwardly so as to facilitate introduction of the steel strip S therebetween when setting up the line to run.

In order to grip the marginal portions of the steel strip S on either side, there are provided a pair of upper and lower edge clamping rolls 78 and 79, spaced on either side of the first pair of belt support rolls 70 and 71. The clamping rolls 78 and 79 may be made adjustable, in this case by making the lower roll 79 moveable towards and away from the upper roll 78 by any suitable adjustment means (not shown).

A pair of upper and lower continuous belts 80 and 81 run around respective upper support rolls 70 and 72 and lower supports rolls 71 and 73 respectively. Mounted on the belts 80 and 81 are a plurality of separate embossing die segment members 82 (shown in more detail in FIG. 12). Each die segment 82 is fastened to its belt 80 or 81 by means such as countersunk bolts passing through a clamping plate 84 located on the belt for the purpose.

The die segments are also preferably held together by link means 82*a* attached at each end as shown in FIG. 12 whereby to take the strain off the belt 90 which then serves simply to smooth out the movement of the die segments.

In order to control the position of the belts 80 and 81, guide plates 85 and 86 are provided, around which respective upper and lower belts 80 and 81 are arranged to slide. The guide plates 85 and 86 are so shaped and located as to gradually force the two belts 80 and 81 together thereby causing them to progressively force the die segments 82 into the steel strip S and progressively gradually form the embossed transverse ridges and grooves.

Any suitable drie means may be provided for driving either the rolls 70 and 71 or 72 and 73 in any required manner, such as is well known in the art. The edge clamping rolls 78 and 79 may also be driven in any suitable manner, the details of which are omitted for the sak of clarity.

As is best shown in FIG. 12, each of the die segments will be seen to comprise a central raised rib portion 87, and flattened end portions 88 at each end thereof, only one such end portion being shown in FIG. 12 for the sake of clarity.

In operation, the steel strip S passes between the edge clamp rollers 78 and 79 clamping either side of the steel strip, and enters into the space between the upper and lower first pair or support rollers 70 and 71. The belts 80 and 81 are moving together in synchronism with their respective embossing die segments 82 meshing with one another. As the die segments 82 approach one another they will gradually deform the central portion of the steel strip S, and progressively gradually form the same into alternate ridges and grooves as described above.

The flattened portion 88 of the die segments also hold the flat side sections of the strip during the formation of the ridges and grooves.

The continuous linked arrangement of die segments provide holding pressure which allows the strip to gradually form in and around the die segments without pulling the extra required material for the formed ridges and grooves. The drawing and stretching takes place with incoming material and no distortion of the edge flat surfaces or of the finished ridges and grooves takes place.

In this way, the desired formations can readily be created, without the requirement of passing the steel strip between two separate pairs of embossing rolls, thereby overcoming the problems of keeping such rolls in synchronism.

According to a further embodiment of the invention, a belt somewhat similar to the belts 80 and 81 may be used in a somewhat different manner.

In this case, one such belt shown as 90 is provided with modified die segments 91 fastened by screws 92 passing through the belt 90 and plate 93, are arranged to run around an arcuate supporting track. Such a track may be provided for example on a sleeve member 96 mounted on a shaft 96*a*.

Each of the die segments 91 is provided with a central raised rib portion 95, and a back surface having curved or arcuate edge portions 94 so as to permit the same to run around the arcuate track. In addition, each of the die members is provided with side shoulders 97 which are formed at an angle so as to taper inwardly whereby when the same are running around the arcuate track, the shoulders 97 may abut snugly together with one another.

The arcuate supporting track may be a metal trackway 100 having a plurality of needle rollers 101 mounted therein. The die segment will then be supported by such needle rollers so as to ensure that at least two die segments are fully engaged with the sheet metal while the third segment is being closed around the sheet.

The die segments 91 on the belt 90 are designed to mesh with raised rib portions 98 formed in a rotating embossing die member 99. The rotating embossing die member 99 is journaled and supported as in the manner described above in connection with FIGS. 1 to 10.

It will be understood that such trackway, or the embossing roll itself will be moveable as described above, so as to discontinue embossing at spaced intervals along the strip.

In this way, as the embossing roll 99 rotates, together with the belt 90 moving around the arcuate track 100, the successive indentations are formed gradually and progressively in the strip S, there being preferably about 3 such embossing die segments 91 in registration with formations on the embossing roll 99, whereby to ensure a fully effective embossing action on the steel strip.

In this manner the invention thereby provides in effect a series of moving dies or die segments which gradually and progressively close and form the ridges and grooves or other formations, while the already formed ridges and grooves are securely held in between closed dies, thereby preventing distortion.

Figure 13:
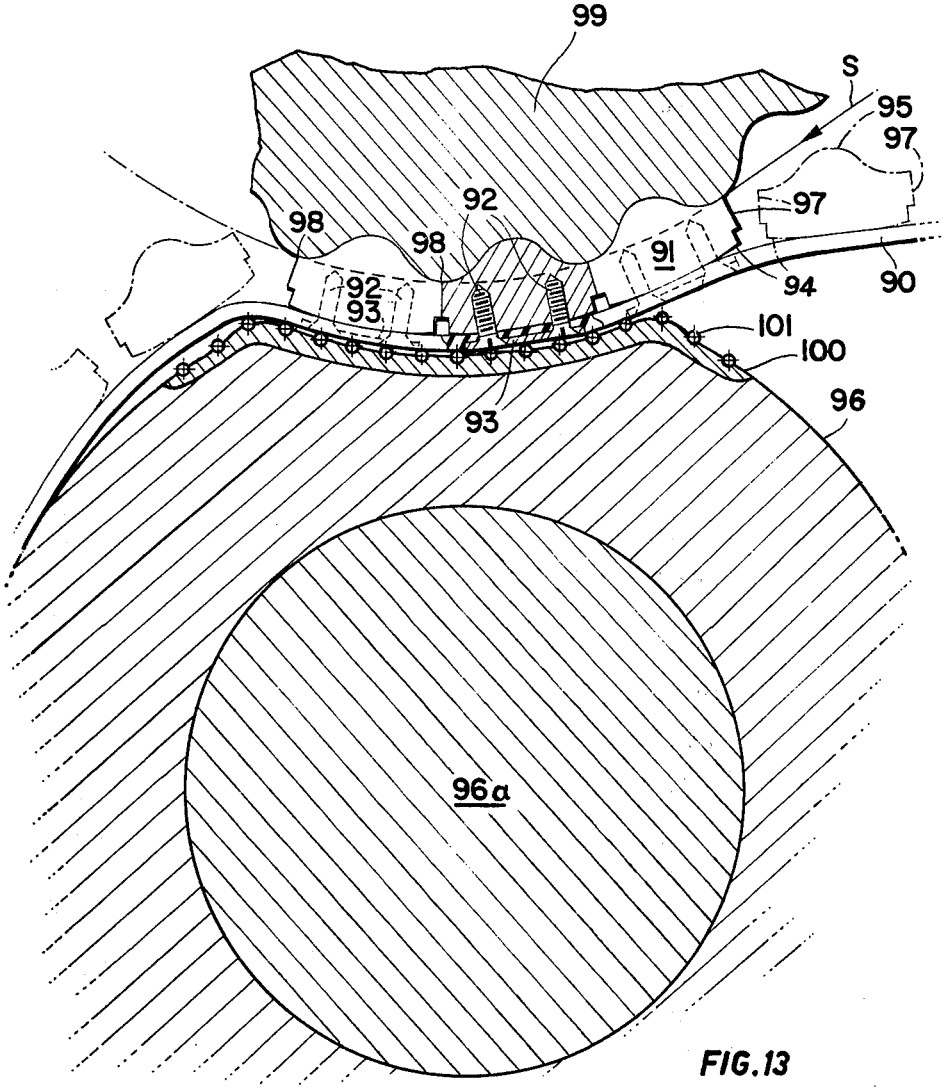
FIG. 13 is a side elevation of a further alternate form of embossing means.

Referring now to FIGS. 14 to 29, the inventive principles disclosed in the embodiment of FIGS. 12 and 13 may be seen to be incorporated an improved form of apparatus.

According to this form of the invention, the entire cold working step has been eliminated, and the strip sheet metal S passes directly from the tension bridle rolls 20 and 21 to the improved form of embossing unit E.

Figure 14:
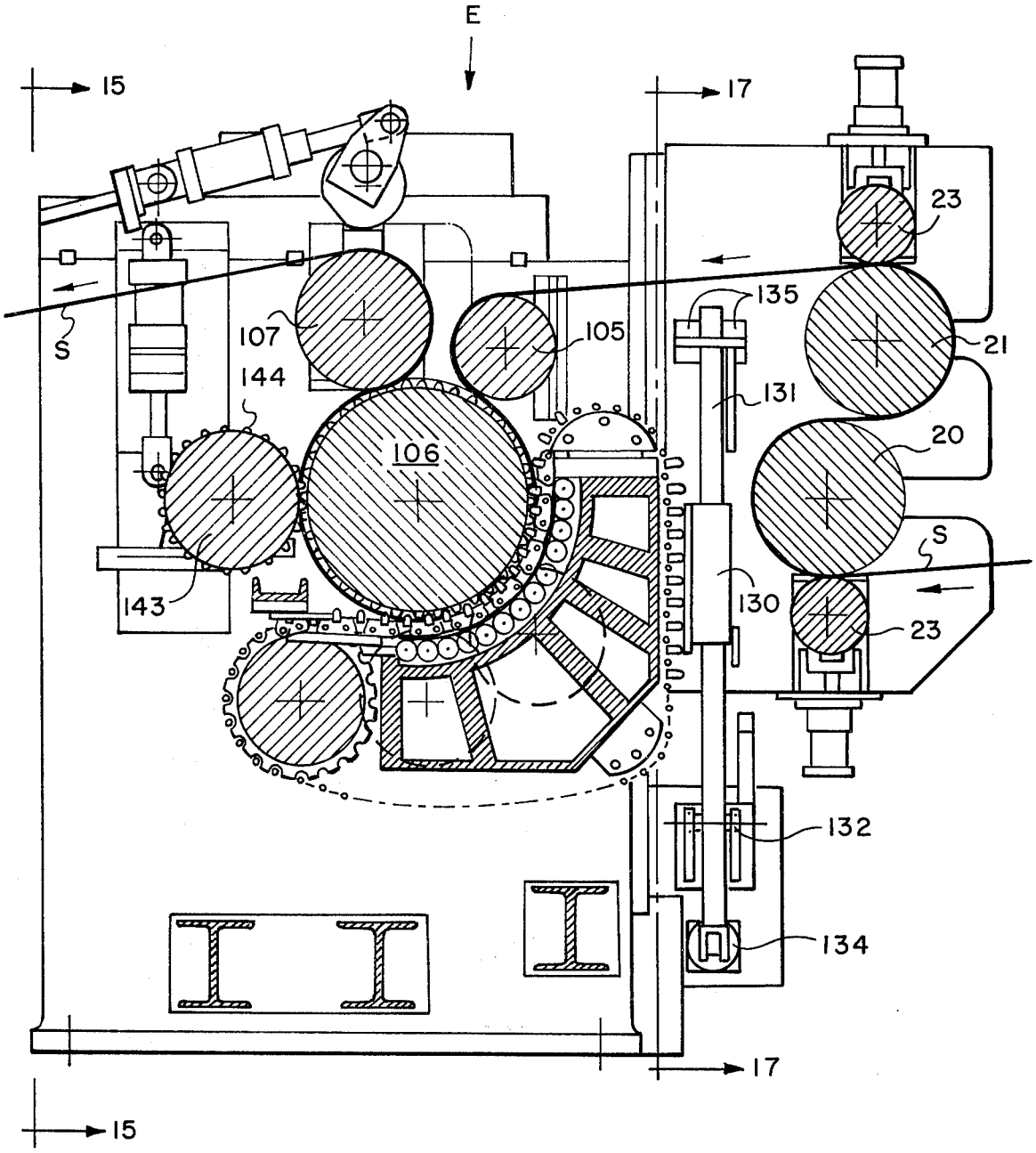
FIG. 14 is a side elevational view of a further form of the invention shown in FIG. 13.
Figure 15:
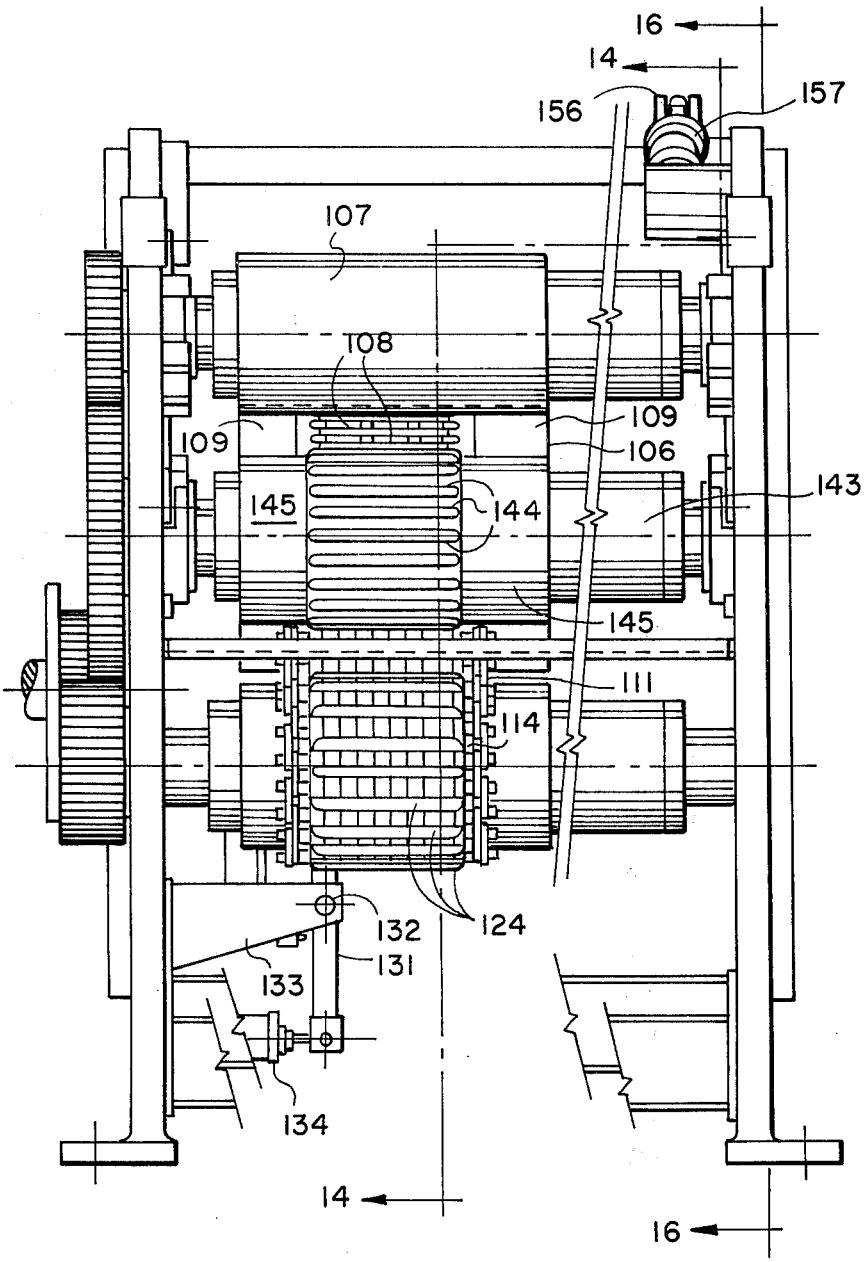
FIG. 15 is a front elevational view along the line 15—15 of FIG. 14.

As shown in FIG. 14, the strip S passes first of all around a turning roll 105 then to the main deep draw roll 106, and extends around the deep draw roll 106 for a substantial arc n excess of 180°, and in this case, in the region of about 270° of arc. The strip leaves the embossing unit E via an upper pressure roll 107.

The turning roll 105 is a free running roll, and simply performs the function of turning the sheet metal strip so that it passes around the main deep draw roll 106. The deep draw roll 106 is of essentially similar construction to the upper roll 99 of FIG. 13, or the upper roll 38 of FIG. 6, and may be seen in perspective in FIG. 29. It will be seen to comprise a central area having a series of die recesses 108 formed in its surface, in a central portion thereof, and is provided with flat cylindrical areas 109 on either side. The side portions 109 may be of varying widths depending upon the proportions of the finished product.

It will be appreciated that the die recesses 108 are separated by ribs 110. However, the apexes of the ribs 110 will be seen to be coplanar with the surfaces of the cylindrical portions 109.

In order to deep draw the sheet metal into the die recesses 108, a system of moving die members similar to that shown in FIG. 13 is provided. The moving die members are shown in more detail in FIGS. 16 and FIGS. 18 to 25, and will be seen to comprise a continuous die conveyor system shown generally as 111 running around a series of idler rolls 112 and 113, and driven by a drive sprocket wheel 114. A series of closely spaced support rolls 115 are arranged and located in an arcuate path about an arc of the deep draw roll 106, which in this case will be seen to be somewhat in excess of 90° of such arc, thereby forcing the conveyor 111 to follow an arcuate path around the surface of deep draw roll 106.

The sprocket 114 and roll 106 are driven in synchronism so as to ensure that they travel at the same peripheral speed.

Figure 18:
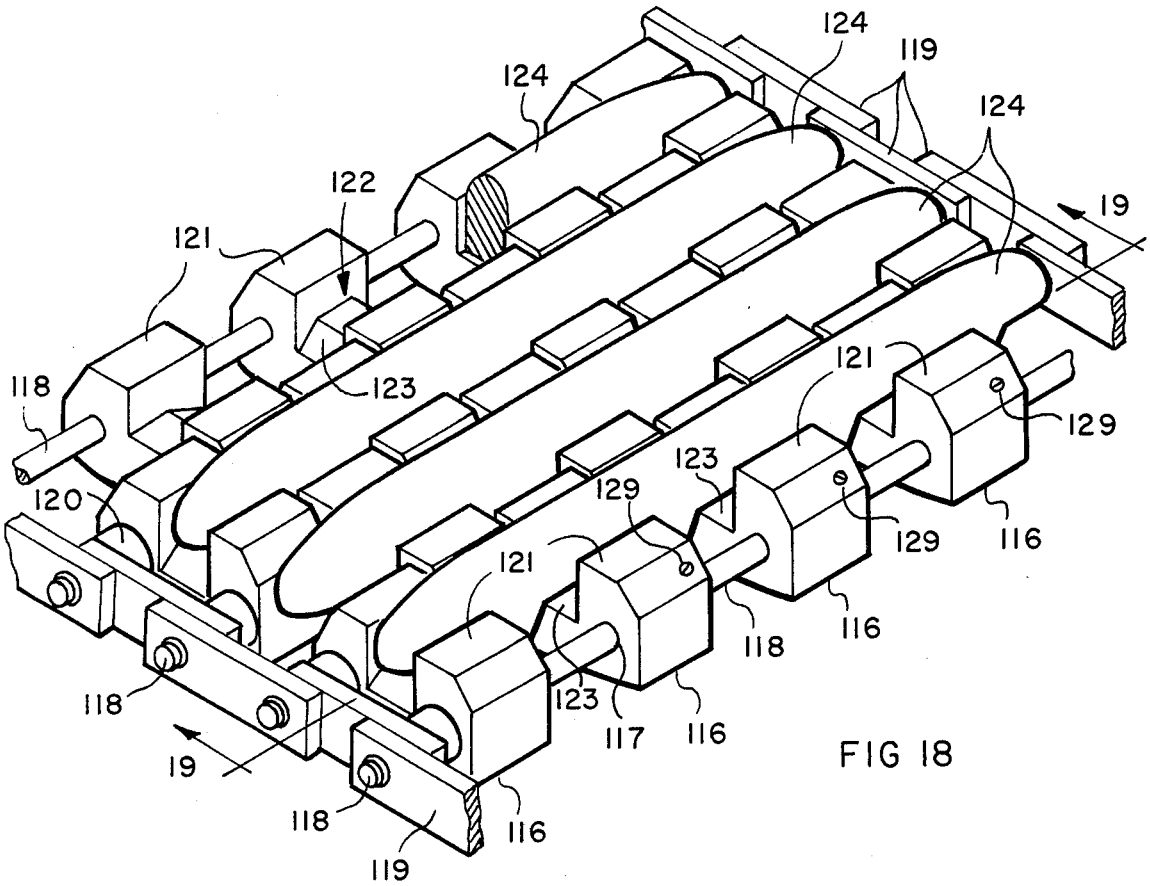
FIG. 18 is an enlarged perspective illustration of the moving die means according to the invention.

The die conveyor system shown generally as 111 will be seen from FIG. 18 to comprise a plurality of individual link blocks 116 each such block 116 being formed with two openings or passageways 117, and the blocks 116 are arranged in a step-wise overlapping fashion, and are linked together by means of track rods 118. The general form of construction will thus be seen to be closely related to that of the track of a tracked vehicle for example.

The rods 118 may be joined together at either end by means of overlapping links 119, spaced outwardly from the outermost of the blocks 116 by means of spacer sleeves 120, which engage the sprocket wheel 114.

It will be noted that the blocks 116 are of generally U-shaped construction in cross-section (FIG. 23) having two side portions 121 defining a central channel 122, and between the two side members 121 the block 116 is formed with angled surfaces 123.

Figure 19:
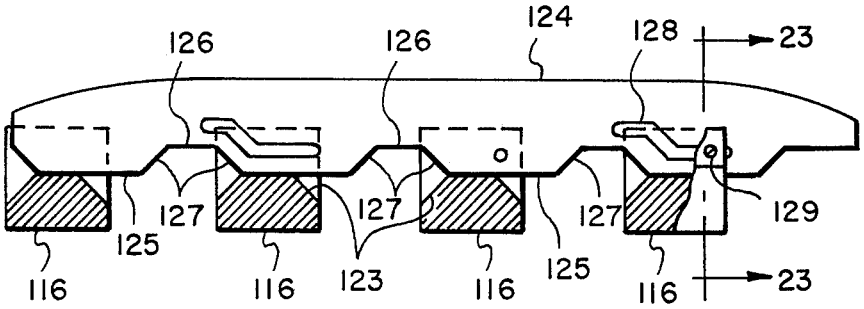
FIG. 19 is a sectional view along the line 19—19 of FIG. 18.

The individual movable die members which are supported on the die conveyor 111 comprise the elongated die elements 124 which lie in the spaces 122 defined between the two side portions 121 of the blocks 116. The upwardly directed surfaces of the die elements 124 whch protrude above the side portions 121 are of smooth rounded shape having end portions which are generally contoured, and cooperate with the die recesses 108 in the deep draw roll 106, and draw the sheet metal into the die recesses 108 and stretch and shape the same into the desired transverse indentations. In order to move the die elements 124 between engaging and disengaging positions, the die elements are movable side-ways along their lengthwise axis as shown in FIGS. 19 and 20. For this purpose, the die elements 124 are provided with spaced apart pad portions 125 separated by recess portions 126. At the transition between a pad portion 125 and a recess 126, there are provided angled camming surfaces 127, which are shaped and angled so as to fit snugly over the angled sufaces 123 of the blocks 116. In order to hold the die elements 124 in position on the blocks 116 their are provided guide grooves 128 in opposite sides of the die elements 124 shaped in the form of an enlongated Z as shown and retaining screws 129 are threadidly engaged in suitable threaded bores in opposite side portions 121 of blocks 116. The retaining bolts 129 fit within the grooves 128, and permit sliding movement of the die elements between the upper position as shown in FIG. 19 in which the die element 124 will be engaging the sheet metal, and the lower position shown in FIG. 20 in which the die element will be disengaged from the sheet metal.

Figure 17:
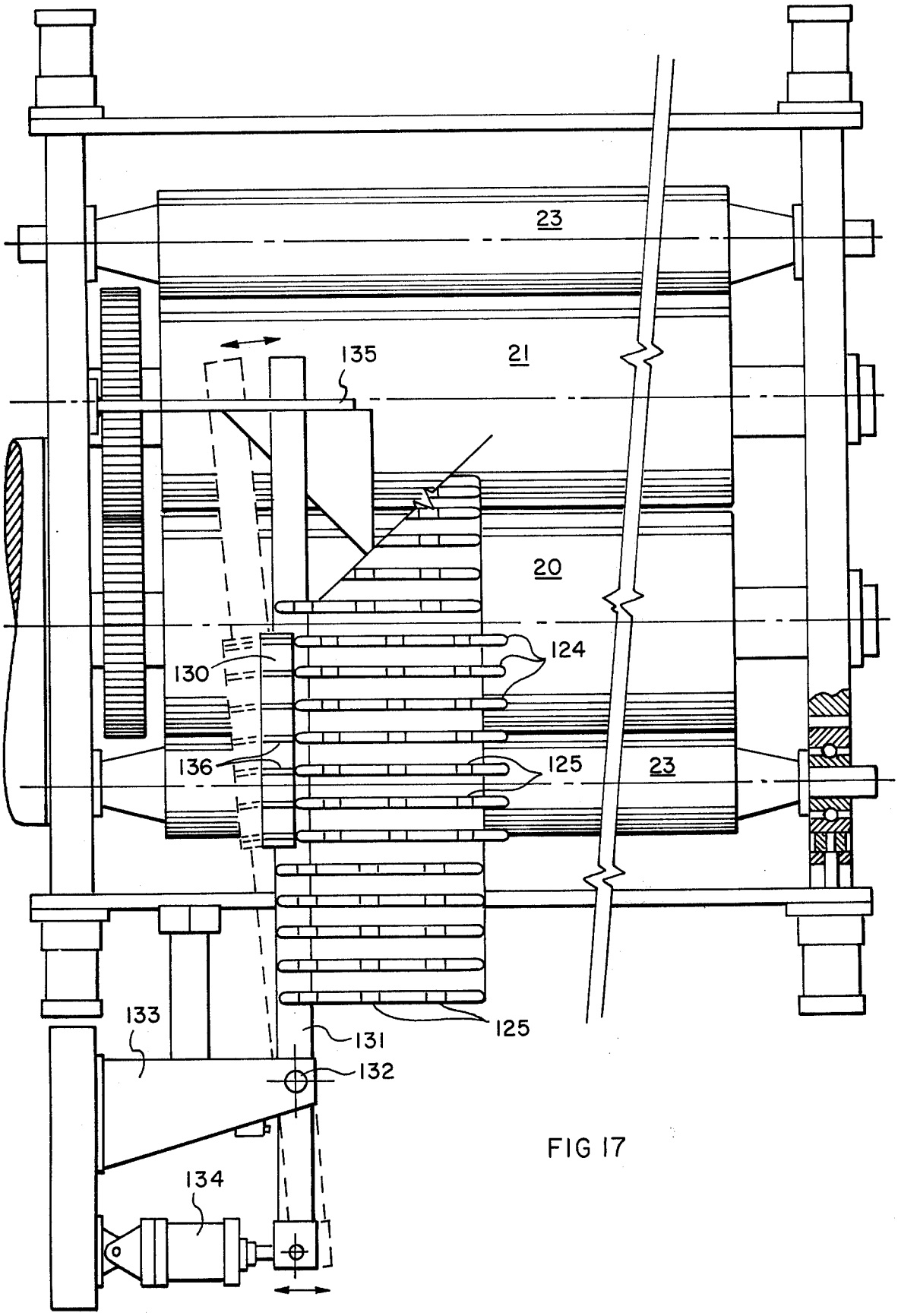
FIG. 17 is a partial section, partially cut-away view shown along the line 17—17 of FIGS. 14 and 16.

In order to move predetermined groups of die elements 124 along their axes from their upper, engaging position, to their lower disengaging position, a die element pusher bar 130 is mounted on an upright operating lever 131. The lever 131 is swingably mounted about a pivot pin 132 on mounting flanges 133 adjacent a substantially vertical portion of conveyor 111. The lower portion of the lever 131, extending below the pivot 132, is connected to power means such as a power cylinder 134, operation of which will cause lateral swinging of the lever 131 between the solid line position and the phantom line position as shown in FIG. 17. The upper end of the lever 131 may be guided as by guide bars 135.

In order to actually contact individual die elements 124, the pusher bar 130 may be provided with contact means such as fingers 136, spaced apart an appropriate distance corresponding to the spacing between die elements 124 on conveyor 111. Different numbers of fingers 136 may be used depending upon the number of die elements which it is desired to displace at any given time.

In this way, provision may be made for flat portions in the finished product, which are either longer or shorter depending upon the specifications of a customer for example.

The cylinder 134 is operated in any suitable automatic manner, in timed synchronism with the operation of the flying shear F, so as to provide the desired flattened portions at the approprite intervals.

Figure 27:
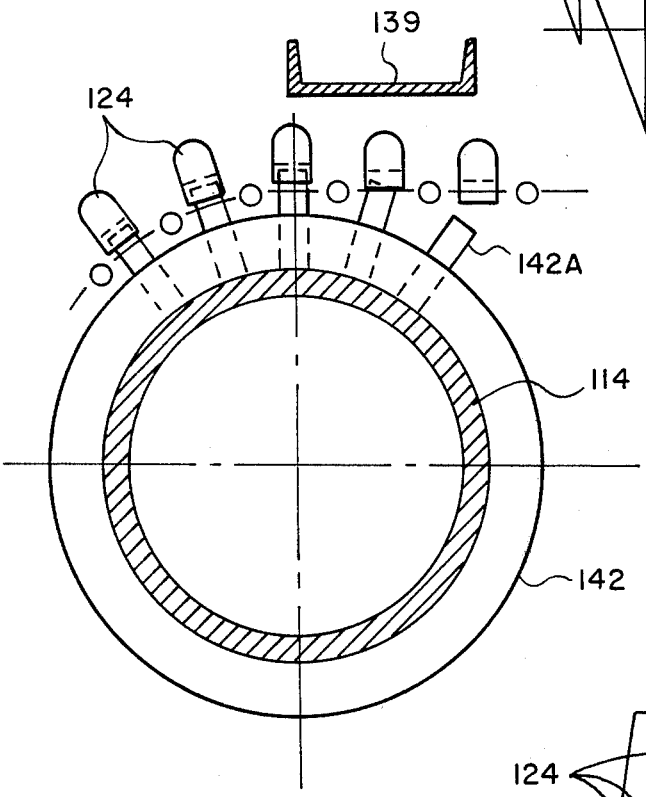
FIG. 27 is a sectional side elevation along the line 27—27 of FIG. 26.

In order to move the die elements 124 along their axes in the reverse direction thereby moving them from the lower disengaging position to the upper engaging position, a die pusher plate 137 is mounted just above the location of the sprocket 114, being fastened to a spacer pad 138 which is itself attached to a mounting bar 139 which extends over the die elements 124 as shown in FIG. 27.

Figure 28:
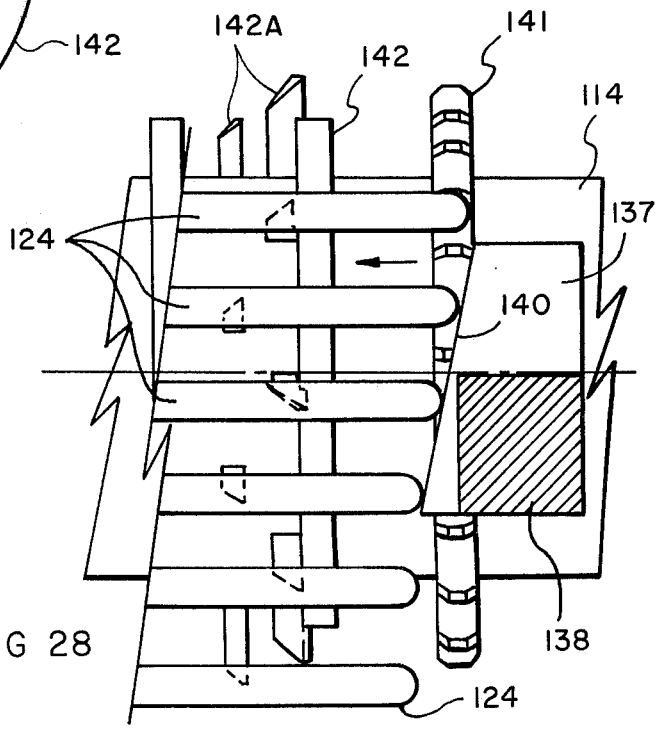
FIG. 28 is a sectional top plan view along the line 28—28 of FIG. 26, and, FIG. 29 is a perspective illustration partially cutaway showing the embossing roll means and the holding roll.
Figure 29:
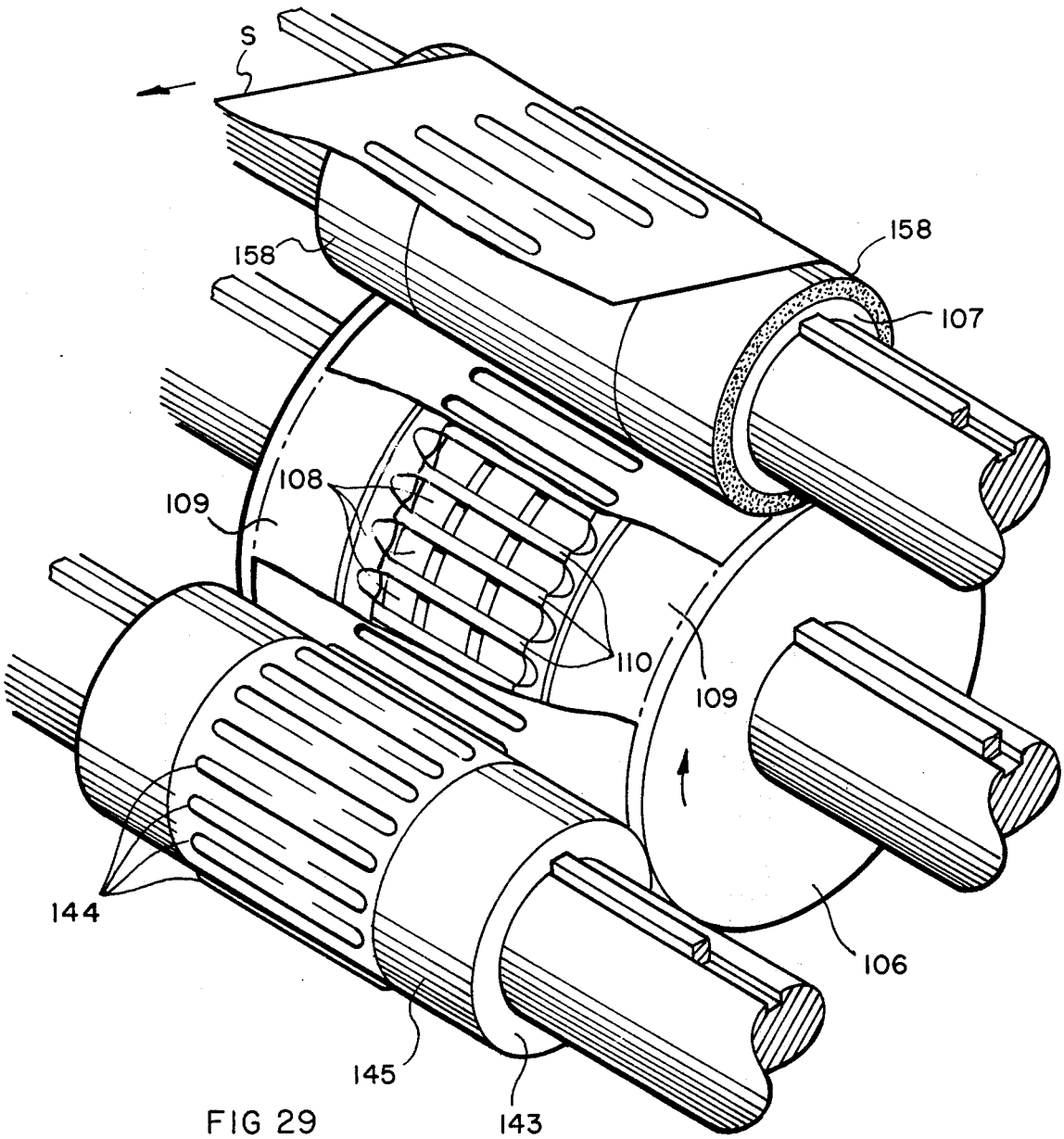

The pusher 137 is provided with an angled camming surface 140 which engages the ends of the die elements 124, and progressively pushes them back into their upper engaging position as shown in FIG. 28.

Figure 26:
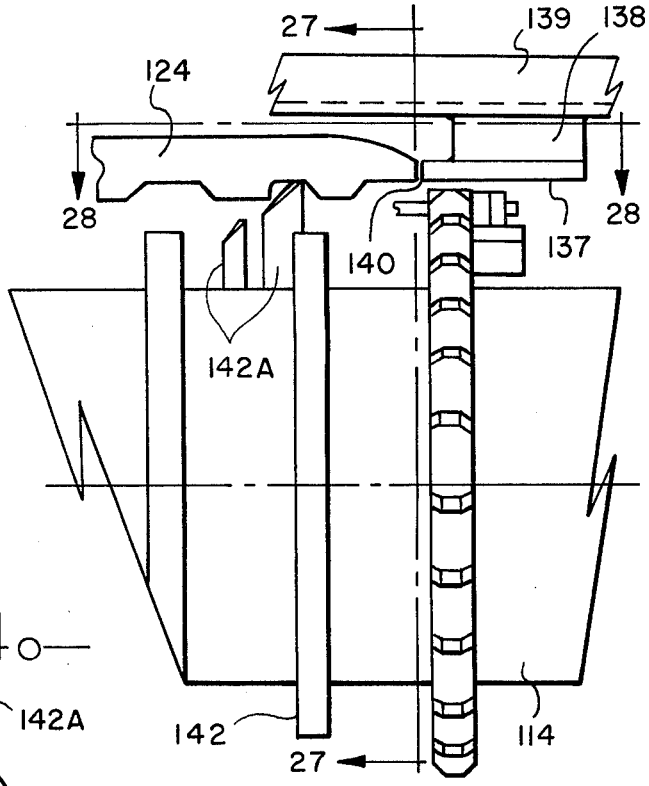
FIG. 26 is an elevational view of a portion of the apparatus shown in FIG. 16 shown along the line 26—26 thereof.

As best shown in FIGS. 26, 27 and 28, the sprocket roll 114 is of generally cylindrical shape, and has a toothed drive ring 141, and a plurality of intermediate spacer ring members 142 spaced apart from one another, for supporting the die conveyor 111. As mentioned above, it is driven any suitable drive means (not shown) in synchronism with the main deep draw roll 106 whereby the conveyor 111 moves at the same speed as the peripheral speed of the main deep draw roll so that individual die elements 124 enter separate die recesses 108, when in their upper position, and, when in their lower disengaged position, register with such recesses 108, but do not enter the same.

In order to hold the transverse indentations in the sheet metal, formed by the die elements 124, a holder roll 143 is rotatably mounted adjacent the main deep draw roll 106, and is driven by any suitable drive means (not shown) in synchronism therewith. The roll 143 is provided with a plurality of transverse ribs 144 standing out from the surface thereof, and arranged to fit into the transverse recesses formed in the sheet metal by the die elements 124. The shape of the transverse ribs 144 will therefore be essentially the same as the shaping and profile of the die elements 124. The holder roll 143, in the same way as the deep draw roll 106, is provided with smooth cylindrical side portions 145, which are of the same lateral extent as the smooth cylindrical portions 109 on the deep draw roll 106. Such smooth cylindrical portions sandwich the side portions of the sheet metal which are not formed with transverse indentations, and hold the same flat during formation of the transverse indentations. The ribs 144 hold the transverse indentations in the sheet metal in the respective die recesses 108 in the roll 106. In this way, the holder roll both prevents malformation of the side portions of the sheet metal, and also prevents slippage of the transverse indentations from their respective die recesses 108.

In order to provide sufficient holding pressure, the roll 143 is mounted between end plates 146 which are slidably mounted on a bed plate 147. The end plates 146 are provided with an angled camming surface 148, which is in turn engaged by a wedge block 149 having a corresponding angled surface 150. The wedge block 149 is slidable vertically by means of any suitable power source such as hydraulic piston 151 by means of which, the block 149 may be moved upwardly or downwardly whereby to reduce or increase the pressure applied by the roll 143 to the roll 106. In order to move the roll 143 away from the roll 106 and bring the ribs 144 out of engagement with the sheet metal, any suitable spring means (not shown) is provided whereby to move the roll 143 when the block 149 is raised upwardly. In this way, it is possible to permit a portion of the sheet metal, which is free of transverse indentations, to pass the roll 143 without contact with the ribs 144.

Any suitable automatic timing mechanism is provided (not shown) the details of which will be evident to persons skilled in the art, whereby to provide for automatic movement of the cylinder 151 so as to ensure movement of the roll 143 away from and towards the roll 106 in timed synchronism with the production of sheet metal in the length required.

In order to provide further flattening pressure on the sheet metal, the upper pressure roll 107 is provided. The roll 107 is of smooth cylindrical construction, preferably being provided at least along part of its length with a layer of hard plastic material having a slight degree of resilience. Typically, such plastic material may be high density polyurethane. However, other plastic materials may be suitable for the purpose in some circumstances. The roll 107 engages only those portions of the sheet metal that have not been indented into the die recesses 108, ie. the marginal portions of sheet metal in contact with the smooth cylindrical portions 109 of roll 106 and 145 of roll 143. It will also engage the portions of sheet metal between the transverse indentations.

However, where a length of the sheet metal is left free of transverse indentations, the considerable pressure applied by the roll 107 to the sheet metal will tend to cause some deformation thereof into the die recesses 108. In order to prevent this, provision is made for moving the roll 107 away from the roll 106. The roll 107 is thus mounted between end plate members 152 which are slidable vertically in any suitable slide means such as the frame side members 153. Upwardly extending pressure pads 154 are connected to the end pates 152, and are engaged by means of the rotatable cam member 155. The rotatable cam member 155 is in turn operated by means of the crank arm 156 and any suitable power source connected thereto such as the hydraulic cylinder 157. Any suitable automatic timing controls will be provided, such as are known to persons skilled in the art, for operating the cylinder 157 automatically in timed relation to the length of sheet metal required.

Any suitable spring means are also provided for moving the roll 107 upwardly, when pressure by means of the cam 155 has been released by operation of the cylinder 157.

In order to assist in raising the die elements 124 from their lower disengaged position to their upper engaging position, the sprocket roll 144 is preferably provided with lifter members **142*a* shaped in such a manner as to engage the under side of the elements 124 when in their lower position and gradually raise them up as shown in FIG. 27. This action, together with the sideways pushing action of the cam plate 137 in the surface 140, cooperate together to move the die elements 124** to their upper engaged position.

However, it will of course be appreciated that if the returning of the die elements 124 to their upper engaged position is carried out at some other location on the path of the conveyor 111, for example, a lower portion of its track, then the force of gravity might provide such function, or any other suitable means may be provided for achieving the movement of the die elements 124 in any other suitable manner.

The ribs 144 on the roll 143, in addition to providing a holding function that is to say holding the sheet metal in the die recesses 108 on the roll 106, also function to perform a final shaping action on the transverse indentations in the sheet metal. For this purpose, the ribs 144 are preferably made slightly shorter than the die elements 124, which, has been found by experience to achieve highly satisfactory results, although other formations of ribs 144 may be suitable for the formation of particular shapes in the sheet metal.

In the operation of this further embodiment of the invention, the sheet metal S passes along the path shown in FIG. 14 that is to say it passes around the tension rolls 20 and 21, and then around the turning roll 105, passes around the main deep draw roll 106 and then upwardly around the turning roll 107. It will then pass from there to the roller die stands, as described in connection with the previous embodiments.

At the point at which the strip S leaves the turning roll 105, and begins to wrap around the deep draw roll 106, the strip S is of course completely flat, and it will therefore be contacting the apexes of the ridges 110 on the roll 106, and the side portions of the strip will be lying on the smooth cylindrical portions 109 of the roll 106. At this point therefore there will be no formation of transverse indentations.

At this point of course the roll 106 is being driven in a clock-wise direction, and the die conveyor 111 is being driven in synchronism with the roll 106 with the die elements 124 in their upper, engaging position, and therefore interlocking with the die recesses 108 between the ridges 110 on the roll 106.

Figure 24:
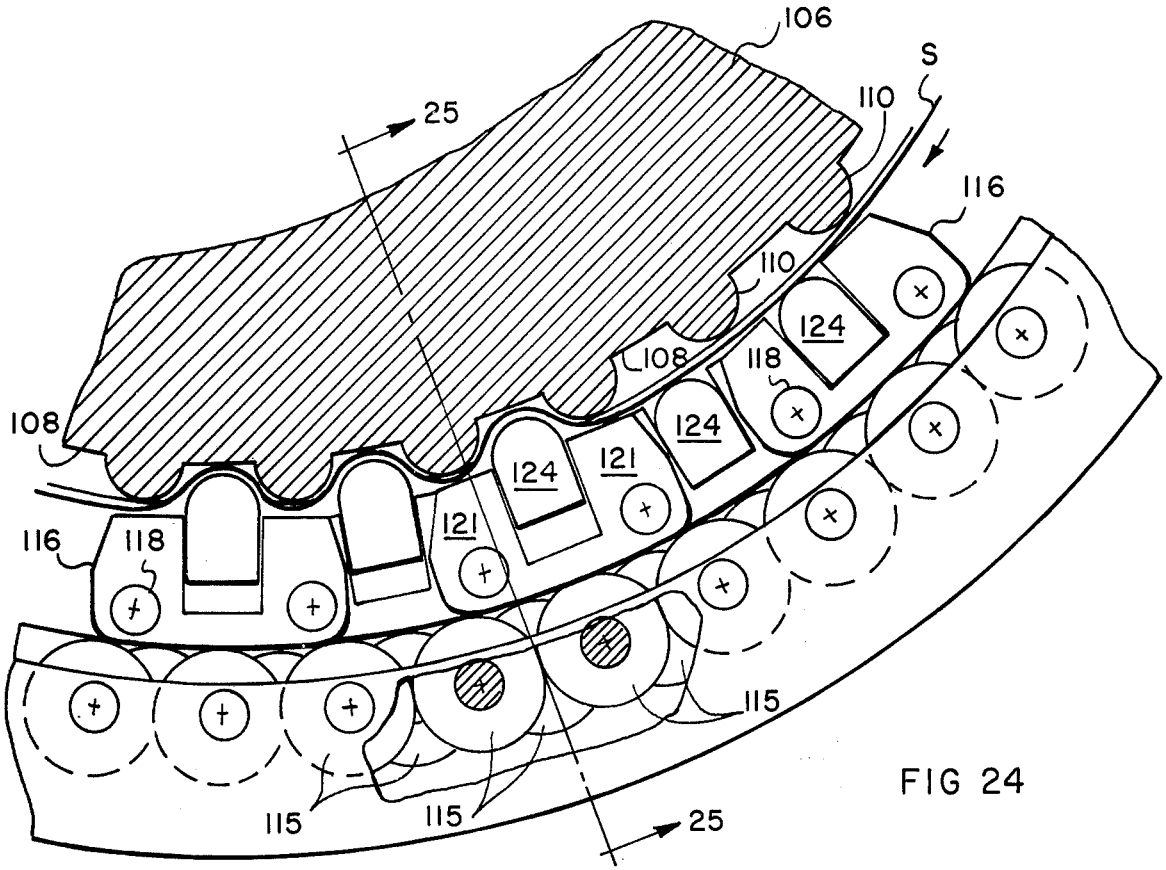
FIG. 24 is a greatly enlarged view of a detail of FIGS. 14 and 16.
Figure 25:
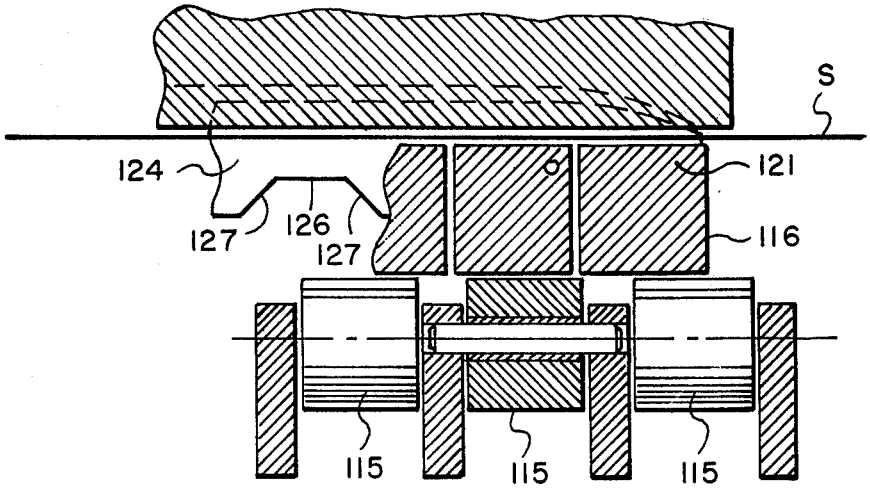
FIG. 25 is a section along the line 25—25 of FIG. 24.

As the strip S therefore approaches the point at which the die elements 124 close with the roll 106, the central portion of the strip S will then be subjected to progressive pressure from the die elements 124 forcing portions of the sheet metal into the die recesses 108 substantially as shown in FIG. 24. The pressure applied by the die elements 124 will be sufficient to cause cold flow of the sheet metal by stressing it beyond its yield point, and will effectively draw the sheet metal into the new shape, in the region of the die elements 124 thereby forming the desired transverse indentations in the central portion. However, the side portions of the strip S remain out of contact with the die elements 124, and will remain flat on the smooth cylindrical side portions 109 of the roll 106.

Figure 16:
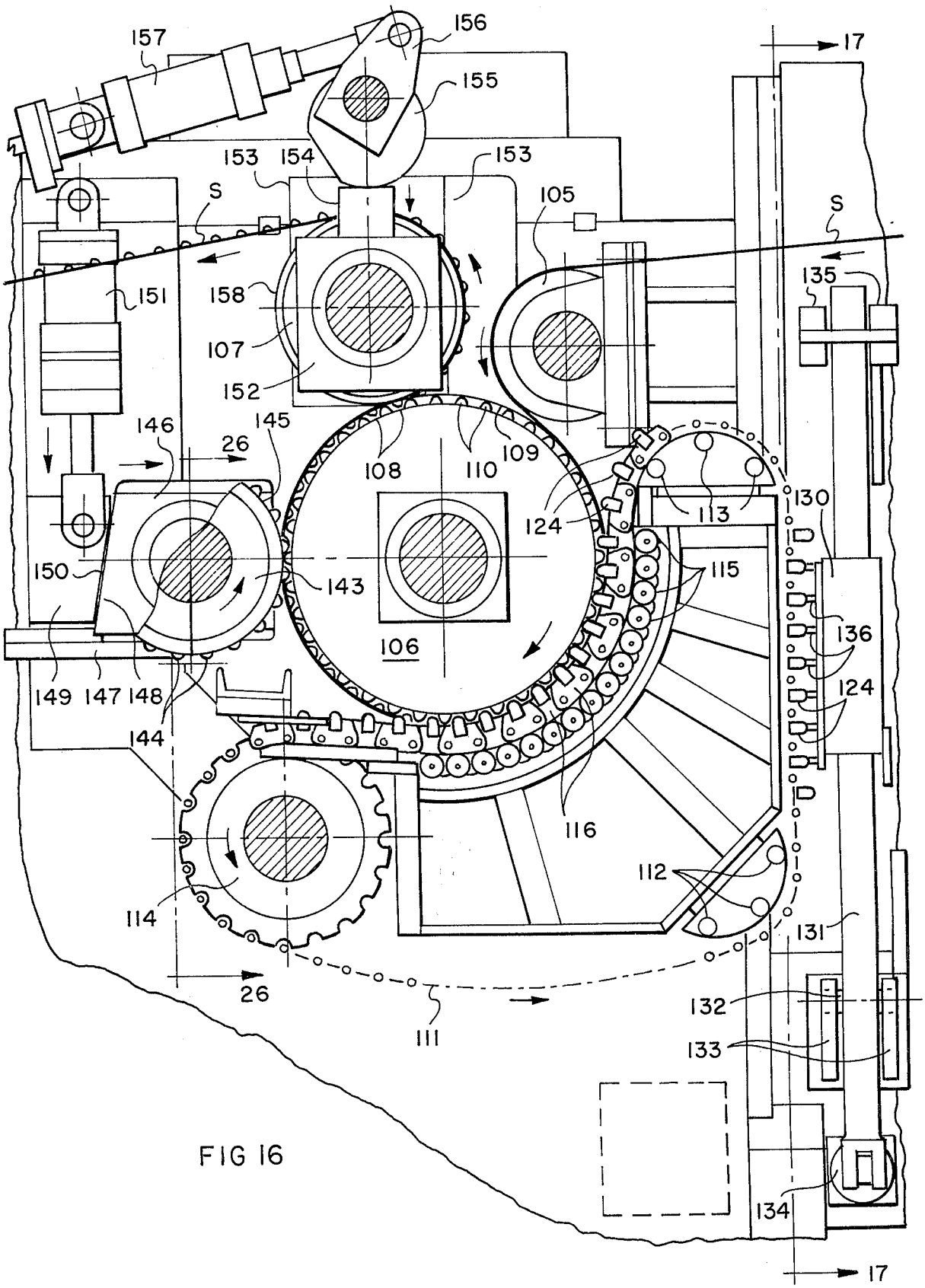
FIG. 16 is a enlarged side elevational view of a portion of the invention as shown in FIG. 14.

As the strip progressively moves along its path, the die elements 124 will gradually become disengaged from the transverse indentations, somewhere about the lowermost point of the roll 106 as shown in FIG. 16, and when that portion of the strip S reaches the roll 143 the transverse indentations will then be engaged by the ribs 144 which finish the forming of the transverse indentations, and at the same time provide a holding and gripping action to prevent the strip S from sliding relative to the roll 106. The smooth cylindrical side portions 145 of the roll 143 will of course engage the side portions of the strip S and provide a holding function in the same manner.

As that portion of the strip S progresses further, it will reach the roll 107. The roll 107, through the medium of its plastic side portions 158 will apply a powerful holding pressure to the smooth portions of the strip S, sandwiching such portions against the smooth cylindrical portions 109 of the roll 106. The central portion of the roll 158 will again provide a certain degree of holding pressure holding the transverse indentations of the central portion in their die recesses 108 on the roll 106.

When it is desired to provide a certain length of the central portion of the strip which is to be flat, and which will provide the two ends of the finished panel, the hydraulic cylinder 134 is operated to swing the lever 131 as shown in FIG. 17 thereby bringing the fingers 136 into engagement with the die elements 124. Preferably, there will be some suitable form of contact sensitive means (not shown) which will ensure that the fingers 136 contact respective die elements 124, and do not pass between them. The hydraulic cylinder 134 then completes its stroke and forces the die elements 124 to move sideways on their blocks 116 as shown in FIGS. 19 and 20. As the die conveyor 111 continues to move, the die elements 124 in their lower position will then remain out of engagement with the sheet metal S as shown in FIG. 24, and that portion of the sheet metal S will then pass around the roll 106 without having transverse indentations formed therein.

When the flat portion of the strip S reaches the roll 143, the cylinder 151 is operated, by any suitable automatic timing controls (not shown) whereby to lift the block 49. The roll 143 will then slide away from the roll 106 under the influence of spring means (not shown) permitting the flat portion of the sheet metal strip S to pass the roll 143 without engagement with the ribs 144. Similarly, when the flat portion of the strip S reaches the roll 107, the cylinder 157 is operated by any suitable automatic control means (not shown) whereby to swing the cam 155 permitting the roll 107 to move upwardly under the influence of spring means (not shown) thereby relieving the pressure applied by it from the strip S. The strip S will however of course pass around and in contact with the roll 107, but without being subjected to the very considerable pressure which had previously been applied by the roll 107.

As soon as the flat portion of the strip S has passed around the roll 143 the same automatic control means will again operate the cylinder 151 bringing the roll 143 back into engagement with the strip, causing the ribs 144 to re-engage with the transverse indentations in the manner described above. Similarly, the roll 107 is again subjected to the pressure of the cylinder 157 whereby to apply pressure to the strip S, as soon as the flat portion has passed between the roll 107 and the roll 106.

The strip S then passes through the roller die stations, and cut off or flying shear, in the manner described above.

Suitable automatic controls may readily be provided in accordance with control systems known to persons skilled in the art, which may be arranged in essentially a similar manner as the controls shown in FIG. 10. As the die elements 124 which are in their lower, disengaged position, reach the die pusher 137 supported on the bar 139 and pad 138, the angled end portion 140 contacts the end of the die elements 124 as shown in FIG. 28 and causes them to move sideways as shown in FIGS. 19 and 20, whereby to resume their upper engaging position. Similarly, the lifter members **142*a* assist in this raising movement of the die elements 124.**

It will of course be understood that there are numerous other automatic sensing devices and controls to provide for trouble-free operation. For example, it is of course necessary for the hydraulic cylinder 134 to return the lever 131 to the phantom line position as shown in FIG. 14 as soon as the die elements 124 have been moved in the manner described above. If it does not so, the bar 130 will then interfere with the following die elements 124 and cause serious damage. Accordingly, a failsafe control is preferably provided to ensure that if the lever 131 for some reason remains in its upright position too long, then the system is shut down. Similar controls may be provided for the cylinders 151 and 157.

It will of course be appreciated that the precise manner in which the die elements 124 are moved from one side to the other between their engaging and disengaging positions is not critical to the invention. Other means of moving such die elements may be provided.

Other changes may be made to the manner in which the foregoing functions are carried out, without departing from the scope of the invention.

By the cooperation of the die recesses 108, die elements 124, and roll 143, and ribs 144, holding the strip under tension, and shaping the indentations, it is possible to draw deep formations into the strip causing substantial cold flow, and in relatively complex shapes having smooth compound convex and concave shapes as shown, while maintaining the side portions flat and free of strains, wrinkles etc. which might otherwise be produced.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. The method of cold forming a continuously moving strip of sheet metal to form successive transverse indentations in a central portion thereof and longitudinal formations down the two side portions thereof said method comprising;

forming a series of transverse indentations in a central portion of said strip by the closing action of continuously moving die means at a forming station while said strip sheet metal is moving along a predetermined path, and while simultaneously holding said strip in tension between two spaced points on opposite sides of said forming station whereby to prevent distortion of said strip during formation of said transverse indentations;

subsequently roll forming continuous longitudinal formations in said side portions of said sheet metal strip which remain free of said transverse indentations, said longitudinal formations extending continuously along both said side portions of said strip, and, intermittently discontinuing said formation of said transverse indentations at predetermined spaced intervals along said sheet metal strip, whereby to leave lengths of said central portion between said continuous longitudinal formations which are flat and planar and free of said transverse indentations at spaced intervals therealong.

2. The method of cold forming strip sheet metal as claimed in claim 1 including the steps of, applying an index mark to said strip sheet metal at each point of discontinuance of said transverse indentations, passing said strip sheet metal through shear means, after completion of said longitudinal formations, and, sensing said indexing marks, and triggering said shear means in response thereto to sever said sheet metal at predetermined lengths in the region of said discontinuances of said transverse identations whereby to produce separate panels having transverse identations and longitudinal formations, and flat planar junction portions at each end, between said longitudinal formations.

3. The method of cold forming strip sheet metal as claimed in claim 2 including the steps of continuously monitoring the speed of said strip sheet metal during said transverse indentation step, and continuously monitoring the speed of said sheet metal during said roll forming step, whereby, to maintain a predetermined relationship between said two speeds.

4. The method of cold forming strip sheet metal as claimed in claim 3 including the step of continuously measuring the length of said sheet metal strip between said transverse indentation step and said roll forming step, whereby to maintain accurate measured index marking of said strip, and accurate measured intermittent discontinuance of said transverse identation step as aforesaid.

5. The method of cold forming strip sheet metal as claimed in claim 4 including the step of continuously measuring said strip sheet metal between said roll forming step and said severing step, and combining the information from said sensing of said indexing mark, and said measuring of said strip sheet metal to procure accurate measured operation of said shear means.

6. The method of cold forming strip metal as claimed in claim 1 wherein said transverse identations are formed by passing said strip around a continuously rotating female die roll member having transverse indentations formed therein, with one side of said strip in contact therewith, and by simultaneously engaging the opposite side of said strip with a plurality of separate die elements, said die elements moving continuously on a conveyor system moving in synchronisn with the rotation of said female die roll means, and extending around a substantial arc thereof.

7. The method of cold forming strip sheet metal as claimed in claim 6 including the steps of displacing some of said die forming elements on said conveyor at predetermined spaced intervals, whereby to disengage the same from said strip, thereby providing said flat planar portions of said central portion as aforesaid, and subsequently again displacing said displaced die elements on said conveyor whereby the same will subsequently be able to engage said strip for forming further indentations as aforesaid.

8. The method of cold forming strip sheet metal as claimed in claim 6 wherein said tensioning of said strip comprises passing said strip around tension roll means located upstream of said moving die means whereby to retard said strip, and engaging said strip with holding roll means located downstream of said moving die means, said holding roll means engaging said transverse identations, and including the step of moving said holding roll means away from said strip at predetermined spaced intervals, whereby to permit said flat planar lengths of said central portion to pass thereby without engagement, and subsequently moving said holding roll means back into engagement with said transverse indentations in said central portion of said strip.

9. Apparatus for forming continuously moving strip sheet metal to form transverse indentations formed along a central portion thereof, and longitudinal formations formed along either side portion thereof, and flat portions between said longitudinal formations at spaced intervals along said central portion, which are free of said transverse indentations, said apparatus comprising;

moving die means arranged on opposite sides of the path of said moving strip operable to form transverse indentations in said central portion of said strip while leaving the side portions free of said indentations;

means for displacing a portion of said moving die means away from one side of said sheet metal strip to discontinue said forming of indentations whereby to define said flat portions of said central portion, and being moveable into engagement with said strip thereafter;

means for holding said strip sheet metal located down stream of said moving die means; whereby tension may be applied thereto during forming said holding means being displaceable out of and into engagement with one side of said strip sheet metal whereby to intermittently discontinue said holding action thereby permitting said flat portions to pass therearound without engagement therewith, and, tension roll means located upstream of said moving die means operable to engage and restrain said strip sheet metal, whereby the same is tensioned between said holding means and said tension roll means to prevent distortion of said strip by said moving die means.

10. Apparatus as claimed in claim 9 wherein said moving die means includes at least one die conveyor means, and a plurality of separate die elements mounted thereon and die recess means co-operating with said die elements and moving in timed relationship therewith, and said die elements being selectively movable relative to said conveyor means for movement between engaging and disengaging positions.

11. Apparatus as claimed in claim 10 including die element displacing means operable at timed intervals whereby to displace groups of said die elements from their said engaging to their disengaging positions, whereby to define said flat portions in said central portion and aforesaid, and including further means for displacing said die elements from their disengaging to their engaging positions once more.

12. Apparatus as claimed in claim 9 wherein said moving die means includes, on at least one side of said sheet metal strip, a plurality of die elements, and linkage movably joining said elements together to form a continuous band of segments, and including track-way means for supporting a portion at least of said continuous band of segments in engagement with said sheet metal.

13. Apparatus as claimed in claim 9 wherein said means for holding said strip includes holding roll means having smooth cylindrical side portions, and a plurality of transverse ribs on the central portion thereof said ribs engaging said transverse indentations in said sheet metal, and including means for moving said holding roll means towards and away from said sheet metal whereby to intermittenly discontinue said holding action.

14. Apparatus as claimed in claim 9 wherein said means for holding said strip includes pressure roll means having a generally smooth cylindrical surface, and including at least one tread portion formed of hard resilient material, and including pressure means for pressing said pressure roll against said strip whereby to hold the same, and being movable between pressing and releasing positions.

15. Apparatus as claimed in claim 10 wherein said die recess means comprises a deep draw roller member having smooth cylindrical side portions, and a central portion having a plurality of transverse die recesses therein, said die recesses receiving respective said separate die elements, and including drive means for driving said die conveyor means, and said deep draw roll means in synchronism.

16. Apparatus as claimed in claim 9 including measuring means measuring said strip sheet metal as the same passes from said holding means and delivering a signal responsive to the length thereof, and, first means responsive to said signal and connected to operate said means for displacing said moving die means, and said holding means, whereby to procure operation thereof at predetermined measured intervals in response to said signal from said measuring means.

17. Apparatus as claimed in claim 16 including roller die means arranged to engage said strip on either side thereof adjacent said central portion, and forming longitudinal formations along said side portions while leaving said central portion free of such longitudinal formations;

second measuring means measuring said strip after formation of said longitudinal formations;

shear means operable to cut off said strip into panels at predetermined measured lengths, and, means responsive to signals from said second measuring means, and connected to operate said shear means whereby to procure operation thereof at precisely measured intervals, thereby shearing said strip in the region of said discontinuance of said transverse indentations.

18. Moving die apparatus for use in the cold forming of moving strip sheet metal, whereby to co-operate with other moving die apparatus to form repetitive formations in said strip transverse to the direction of travel thereof, said moving die apparatus comprising;

a plurality of link members arranged in a plurality of continuous longitudinal rows;

interconnecting means connecting end portions of adjacent said links in said rows transversely thereof, whereby to form the same into a continuous track-like band;

a plurality of separate die elements mounted transversely on said link members in spaced apart location;

die element retaining means engaging the same and securing them on said link members, and, die element moving means for moving groups of said die elements to and fro relative to said sheet metal.

19. Moving die apparatus as claimed in claim 18 wherein each said link member is of a generally channel shaped cross-section along its length and including passage ways formed transversly thereof at both said ends, and said channel shaped section defining a central recess for reception of a portion of said die element therein.

20. Moving die apparatus as claimed in claim 19 including camming surface means formed at the bottom of said central recess, and wherein said die elements are formed with complimentary camming surfaces engaging said camming surfaces on said link members, whereby axial movement of said die elements will procure vertical displacement of said die elements relative to said link members by interaction between said camming surfaces whereby to displace said die elements upwardly or downwardly relative to said link members.

21. Moving die apparatus as claimed in claim 20 including guide groove means formed in said die elements, and retaining pin means fastened in said link members, and extending into said guide groove means, said guide groove means being shaped with two parallel spaced apart groove portions, and an intermediate groove portion connecting said two parallel groove portions, said intermediate portion being angled at an angle corresponding to the angling of said camming surfaces whereby to guide movement of said die elements, and simultaneously retain them in position on said link members.

22. Moving die apparatus as claimed in claim 18 wherein said die elements are individually movable relative to said link members between an in use position and a displaced inoperable position, and wherein said die element moving means comprises die element displacing means for moving said die elements from said in use to said inoperable position, and die element return means for reversing such movement.

23. Moving die as claimed in claim 22 wherein said die elements are axially movable as aforesaid, and wherein said displacing means engages said die elements at one end thereof and said return means engages said die elements at their other ends.

* * * * *